US011117735B2

(12) United States Patent
Cassoni et al.

(10) Patent No.: US 11,117,735 B2
(45) **Date of Patent: *Sep. 14, 2021**

(54) VALVE ASSEMBLY FOR DISPENSERS

(71) Applicant: The Procter & Gamble Company, Cincinnati, OH (US)

(72) Inventors: Robert Paul Cassoni, Waynesville, OH (US); David Andrew Dalton, Mason, OH (US); Matthew David Fitts, Fairfield, OH (US); Andrew William Franckhauser, Batavia, OH (US); Paul Owen Nutley, West Chester, OH (US); Scott Edward Smith, Cincinnati, OH (US); Kerry Lloyd Weaver, Florence, KY (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/914,509

(22) Filed: Jun. 29, 2020

(65) Prior Publication Data

US 2021/0024280 A1 Jan. 28, 2021

Related U.S. Application Data

(60) Provisional application No. 63/021,140, filed on May 7, 2020, provisional application No. 62/878,919, filed on Jul. 26, 2019.

(51) Int. Cl.

| | |
|---|---|
| ***B65D 83/48*** | (2006.01) |
| ***B65D 83/20*** | (2006.01) |
| ***B65D 83/32*** | (2006.01) |

(52) U.S. Cl.

CPC ..... *B65D 83/48* (2013.01); *B65D 83/205* (2013.01); *B65D 83/32* (2013.01)

(58) Field of Classification Search

CPC ..... B65D 83/48; B65D 83/205; B65D 83/32

(Continued)

(56) References Cited

U.S. PATENT DOCUMENTS

| | | | |
|---|---|---|---|
| 2,704,172 | A | 3/1955 | Lapin |
| 2,704,622 | A | 3/1955 | Soffer |

(Continued)

FOREIGN PATENT DOCUMENTS

| | | | |
|---|---|---|---|
| EP | 2253809 | B1 | 3/2012 |
| WO | WO9108099 | A1 | 6/1991 |

(Continued)

OTHER PUBLICATIONS

EP Search Report; Application No. 19160210.1; dated Aug. 1, 2019; 12 pages.

(Continued)

*Primary Examiner* — Paul R Durand
*Assistant Examiner* — Michael J. Melaragno
(74) *Attorney, Agent, or Firm* — Steven Robert Chuey; James E Oehlenschlager

(57) ABSTRACT

A valve assembly for a dispenser. The valve assembly includes a valve body that extends about a longitudinal axis and defines an outer surface and an inner passageway. A valve stem extends through the inner passageway and includes an outer stem surface, an inner stem surface opposite the outer stem surface, a fin extending radially outward from the outer stem surface, and a first orifice extending from the outer stem surface to the inner stem surface. The fin operatively engages a portion of the inner passageway forming a first seal and providing controlled dispensing through the orifice. A valve seal may be joined to the valve steam. The vale seal may operatively engage a portion of the valve body forming a second seal.

19 Claims, 16 Drawing Sheets

(58) Field of Classification Search
USPC ..... 222/402.13
See application file for complete search history.

(56) References Cited

U.S. PATENT DOCUMENTS

| | | | | |
|---|---|---|---|---|
| 2,812,884 | A | 11/1957 | Ward | |
| 2,829,806 | A | 4/1958 | Tedaldi | |
| 2,863,699 | A | 12/1958 | Elser | |
| 2,994,461 | A | 8/1961 | Daniel | |
| 3,024,949 | A * | 3/1962 | Sagarin | B65D 83/48 222/402.24 |
| 3,101,875 | A | 8/1963 | Daniel | |
| 3,333,743 | A | 8/1967 | Meyers | |
| 3,403,804 | A | 10/1968 | Colombo | |
| 3,450,254 | A | 6/1969 | Miles | |
| 3,450,316 | A | 6/1969 | Barker | |
| 3,549,050 | A | 12/1970 | Bruce | |
| 3,581,941 | A | 6/1971 | Bruce | |
| 4,165,825 | A | 8/1979 | Hansen | |
| RE30,093 | E | 9/1979 | Burger | |
| 4,171,757 | A * | 10/1979 | Diamond | B65D 83/64 222/389 |
| 4,330,066 | A | 5/1982 | Berliner | |
| 4,469,253 | A * | 9/1984 | Beard | B65D 83/40 215/250 |
| 4,513,889 | A * | 4/1985 | Beard | B65D 83/40 215/256 |
| 4,765,516 | A | 8/1988 | Metcoff | |
| 4,805,813 | A | 2/1989 | Metcoff | |
| 4,958,755 | A | 9/1990 | Gerstung | |
| 5,785,301 | A | 7/1998 | Scheindel | |
| 5,957,342 | A * | 9/1999 | Gallien | B65D 83/46 222/402.22 |
| 6,019,252 | A | 2/2000 | Benecke et al. | |
| 6,039,222 | A | 3/2000 | Smith | |
| 6,058,960 | A | 5/2000 | Kopp | |
| 6,254,820 | B1 | 7/2001 | Cornell | |
| 6,978,915 | B1 | 12/2005 | Russell | |
| 7,028,866 | B2 | 4/2006 | Kunesh et al. | |
| 7,168,684 | B2 | 1/2007 | Marroncles | |
| 7,234,460 | B2 | 6/2007 | Greenleaf | |
| 7,279,207 | B2 | 10/2007 | Darr | |
| 7,303,087 | B2 | 12/2007 | Flashinski et al. | |
| 7,481,338 | B1 | 1/2009 | Stern | |
| 7,769,842 | B2 | 8/2010 | Weber | |
| 8,074,847 | B2 | 12/2011 | Smith | |
| 8,096,327 | B2 | 1/2012 | Hirz | |
| 8,418,996 | B2 | 4/2013 | Rideg | |
| 8,505,762 | B2 | 8/2013 | Holbach et al. | |
| 8,511,522 | B2 | 8/2013 | Chan et al. | |
| 8,631,632 | B2 | 1/2014 | Morales et al. | |
| 8,844,765 | B2 | 9/2014 | Tryon | |
| 8,869,842 | B2 | 10/2014 | Smith | |
| 8,905,273 | B2 | 12/2014 | De Schrijver | |
| 9,061,795 | B2 | 6/2015 | Girardot et al. | |
| 9,132,955 | B2 | 9/2015 | Smith et al. | |
| 9,174,229 | B2 | 11/2015 | Smith | |
| 9,296,550 | B2 | 3/2016 | Smith et al. | |
| 9,334,103 | B2 | 5/2016 | Soliman | |
| 9,446,894 | B2 | 9/2016 | Martz | |
| 9,446,895 | B2 * | 9/2016 | Mekata | B65D 83/384 |
| 9,758,294 | B2 | 9/2017 | McDaniel et al. | |
| 9,975,656 | B2 | 5/2018 | Smith | |
| 10,040,622 | B2 | 8/2018 | Dellinger | |
| 2005/0121476 | A1 | 6/2005 | Pauls | |
| 2009/0001103 | A1 | 1/2009 | Wanbaugh | |
| 2009/0014679 | A1 | 1/2009 | Hygema et al. | |
| 2010/0224656 | A1 | 9/2010 | Scheindel | |
| 2011/0248035 | A1 | 10/2011 | Peirsman et al. | |
| 2012/0006859 | A1 * | 1/2012 | Wilkinson | B65D 83/46 222/402.21 |
| 2013/0062369 | A1 | 3/2013 | Engel | |
| 2013/0200111 | A1 | 8/2013 | De Schrijver | |
| 2014/0048568 | A1 | 2/2014 | Demey | |
| 2014/0131396 | A1 * | 5/2014 | Smith | B65D 83/20 222/402.1 |
| 2015/0014990 | A1 | 1/2015 | Bodet | |
| 2015/0108387 | A1 | 4/2015 | Smith | |
| 2015/0375922 | A1 | 12/2015 | Smith | |
| 2016/0368633 | A1 | 12/2016 | Smith et al. | |
| 2016/0368700 | A1 | 12/2016 | Smith | |
| 2016/0376087 | A1 * | 12/2016 | Smith | B65D 83/425 222/402.1 |
| 2016/0377186 | A1 * | 12/2016 | Smith | B65D 83/425 251/325 |
| 2016/0377231 | A1 | 12/2016 | Smith | |
| 2018/0043604 | A1 | 2/2018 | Zeik et al. | |
| 2018/0044097 | A1 | 2/2018 | Zeik et al. | |
| 2018/0134481 | A1 | 5/2018 | Bodet | |
| 2018/0222613 | A1 | 8/2018 | Geier | |
| 2018/0333920 | A1 | 11/2018 | Cassoni | |
| 2018/0334276 | A1 | 11/2018 | Cassoni | |
| 2018/0339841 | A1 | 11/2018 | Magness | |
| 2018/0339843 | A1 | 11/2018 | Cassoni | |
| 2018/0339844 | A1 | 11/2018 | Cassoni | |
| 2019/0077558 | A1 * | 3/2019 | Smith | B65D 49/00 |
| 2019/0077582 | A1 * | 3/2019 | Franckhauser | B65D 83/44 |
| 2019/0077583 | A1 | 3/2019 | Weaver | |
| 2019/0077584 | A1 | 3/2019 | Magness | |
| 2019/0135529 | A1 * | 5/2019 | Zeik | B65D 83/38 |
| 2019/0168242 | A1 | 6/2019 | Maguire | |
| 2019/0276221 | A1 | 9/2019 | Franckhauser | |
| 2021/0024280 | A1 * | 1/2021 | Cassoni | B65D 83/48 |
| 2021/0024281 | A1 * | 1/2021 | Cassoni | B65D 83/48 |
| 2021/0025500 | A1 * | 1/2021 | Cassoni | F16K 1/303 |
| 2021/0025501 | A1 * | 1/2021 | Dalton | F16K 41/02 |
| 2021/0025502 | A1 * | 1/2021 | Dalton | F16K 1/303 |
| 2021/0025503 | A1 * | 1/2021 | Dalton | F16K 1/303 |
| 2021/0025518 | A1 * | 1/2021 | Dalton | B65D 83/32 |
| 2021/0078791 | A1 * | 3/2021 | Cassoni | B65D 83/425 |

FOREIGN PATENT DOCUMENTS

| | | | |
|---|---|---|---|
| WO | WO0110743 | A1 | 2/2001 |
| WO | WO2017021039 | A1 | 2/2017 |

OTHER PUBLICATIONS

All Office Actions, U.S. Appl. No. 15/912,643.
International Search Report and Written Opinion; Application No. PCT/US2020/070209; dated Sep. 9, 2020, 15 pages.

* cited by examiner

VALVE ASSEMBLY FOR DISPENSERS

FIELD

The present disclosure is directed to a valve assembly, and, in particular, to a valve assembly including a stem having one or more fins and a valve seal.

BACKGROUND

Dispensers typically comprise a container, which may act as a pressure vessel for propellant and product contained therein. Pressurized dispensing systems, such as systems used to dispense aerosol products, have conventionally included metallic (e.g., steel or aluminum) containers for containing the product under pressure before it is dispensed from the system. Examples of products that are dispensed with such systems include air fresheners, fabric fresheners, insect repellants, paints, body sprays, hair sprays, shoe or footwear spray products, whipped cream, and processed cheese. Recently, there has been increased interest in using polymeric bottles as an alternative to metallic containers in pressurized dispensing systems because polymeric bottles have several potential advantages. For example, polymeric bottles may be easier and cheaper to manufacture than metallic containers, and polymeric bottles may be made in a wider variety of shapes than metallic containers. Additionally, metal containers may be undesirable due to relatively higher cost and being relatively less sustainable.

The containers are typically, but not necessarily, axisymmetric. The container may include a closed end bottom for resting on horizontal surfaces such as shelves, countertops, tables etc. The bottom of the container may comprise a re-entrant portion or base cup. The sidewalls generally define the shape of the container and extend upwardly from the bottom to an opening at a top of the container. The opening at the top of the container defines a neck.

Typically, a valve assembly 8 may be joined to a container to allow for selective dispensing of a product. With reference to FIG. 1, the valve assembly 8 may include a metal valve cup 10 inserted at least partially into the neck of the container. The valve cup 10 is crimped against a crimp ring of a container to seal the container and prevent the escape of propellant, product, and loss of pressurization. The valve cup 10 may define a central opening about through which a stem may extend. Positioned between a portion of the stem 14 and the valve cup 10 may be a gasket 16. The gasket 16 may be made from an elastomer, and traditionally, a cross linked elastomer, such as cross-linked vulcanized rubbers. The gasket 16 may be used to seal the interface between the valve cup 10 and the stem 14. The stem 18 may extend through the central opening in the valve cup 10 and engage a portion of the gasket 16. The portion of the stem that extends from the central opening of the valve cup towards the bottom of the outer contain may engage a housing 12 and a spring 20. The portion of the stem 14 may push the spring 20 towards the bottom of the container to allow product to pass from the container and into the interior of the stem and out through the actuator 18. Upon release of the actuator 18 and/or the stem 14, the spring may push the stem in a direction away from the bottom of the container, which stops the release of material from inside the container to ambient. The spring 20 is typically made from metal. The spring 20 is supported by the housing 12.

To selectively dispense product from an aerosol dispenser, the valve assembly includes a number of different components. These components are made from a number of different materials including metal and polymeric, which may be plastic, components. However, for producing an aerosol dispenser that is both recyclable and economical, it is generally desirable to have all the components made from polymeric materials or to minimize the number of component parts made from other than polymeric materials.

SUMMARY

In some embodiments, a valve for a container may include a valve body extending about a longitudinal axis. The valve body may define an outer surface and an inner passageway. The inner passageway includes a first passageway opening and a second passageway opening and a passageway surface extending from the first passageway opening to the second passageway opening. The valve may also include a valve stem extending through the inner passageway. The valve stem includes an outer stem surface and an inner stem surface opposite the outer stem surface. The valve stem includes a first portion adjacent to the first passageway opening, a second portion substantially surrounded by the passageway surface, and a third portion adjacent to the second passageway opening. A valve seal may be joined to the third portion of the valve stem. A fin may extend radially outward from the outer stem surface of the valve stem and an orifice may extend from the outer stem surface to the inner stem surface of the valve stem. The inner stem surface may define a channel in fluid communication with the orifice. The fin may include a root portion joined to the outer stem surface and a tip portion opposite the root portion. The tip portion of the fin may be configured to operatively engage the passageway surface to form a seal.

In some embodiments, the valve for a container may include a valve body extending about a longitudinal axis, the valve body defining an outer surface and an inner passageway. The inner passageway includes a first passageway opening and a second passageway opening, and a passageway surface extending from the first passageway opening to the second passageway opening. The valve may also include a valve stem that extends through the passageway. A first portion of the valve stem may be adjacent to the first passageway opening, a second portion of the valve stem may be substantially surrounded by the passageway surface, and a third portion of the valve stem may be adjacent to the second passageway opening. The valve stem may include an outer stem surface and an inner stem surface opposite the outer stem surface. A fin may be joined to the valve stem. The fin may be configured to operatively engage the passageway surface to form a first seal. A valve seal may be joined to the valve stem. A portion of the valve seal may be configured to operatively engage a portion of the valve body to form a second seal.

In some embodiments, a pressurizable container for dispensing a product may include a container and a valve body joined to the container. The valve body may define an outer surface and an inner passageway. The inner passageway includes a first passageway opening and a second passageway opening and a passageway surface extending from the first passageway opening to the second passageway opening. A valve stem may extend through the passageway. The valve stem may include an outer stem surface and an inner stem surface opposite the outer stem surface. A fin may extend radially outward from the outer stem surface. The fin includes a root portion joined to the outer stem surface and a tip portion opposite the root portion. The tip portion of the fin may operatively engage the passageway surface to form a first seal. A valve seal may be joined to the valve stem and the valve seal may be configured to operatively engage a portion of the valve body to form a second seal. A product delivery device may be in fluid communication with the valve body.

DETAILED DESCRIPTION

Figure 1:
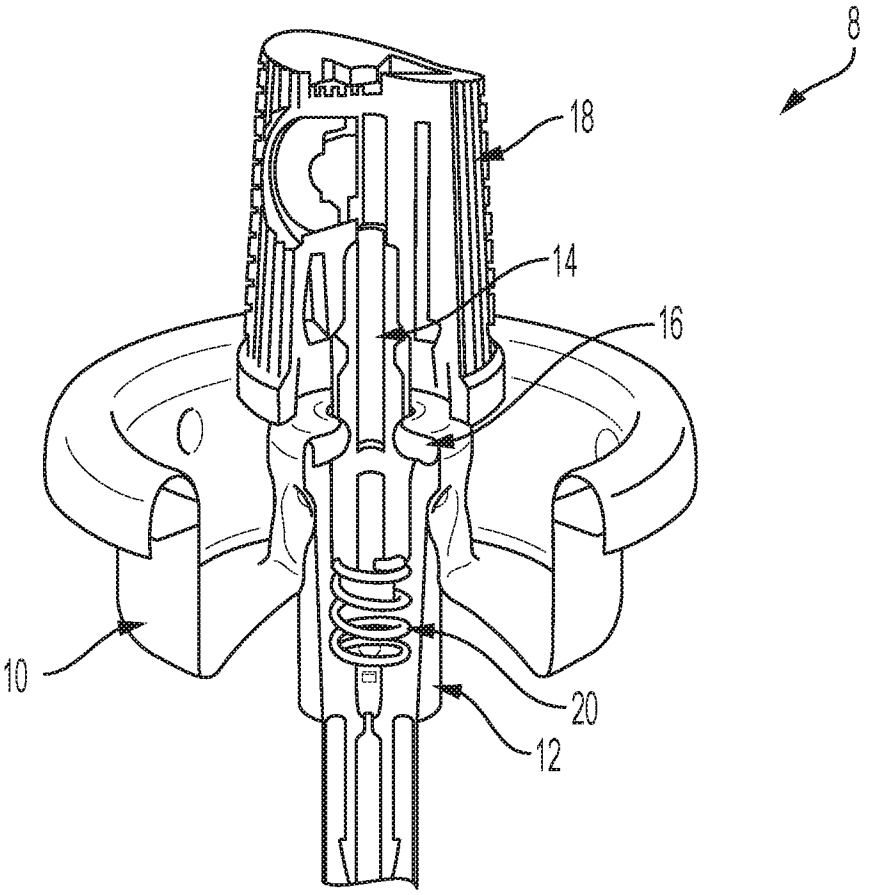
FIG. 1 PRIOR ART
FIG. 1 is a sectional view of a prior art, industry standard valve assembly including a metal crimp ring.
Figure 2B:
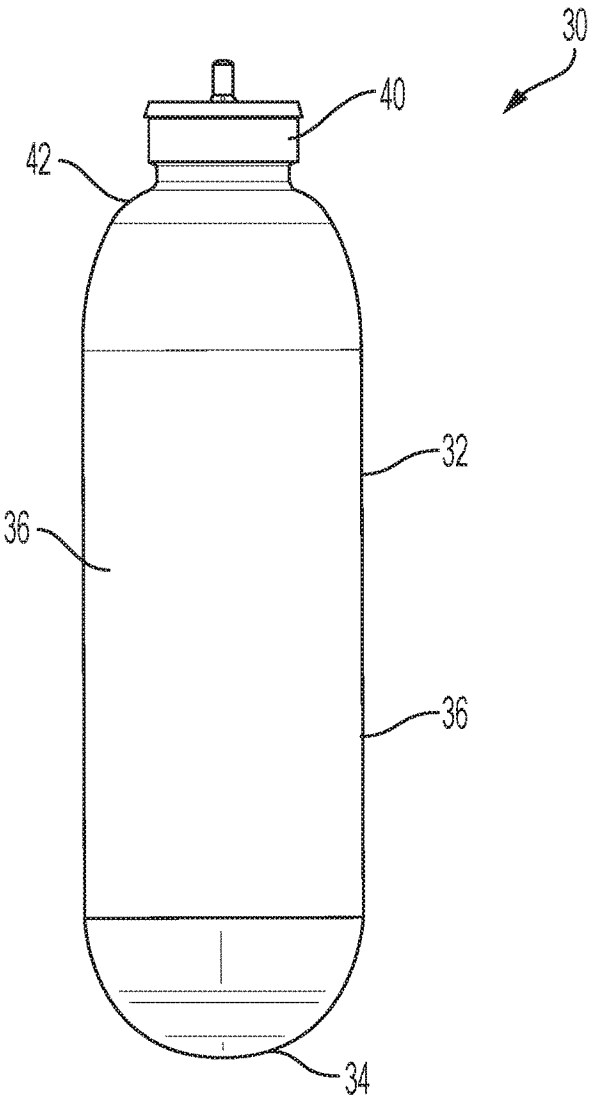
FIG. 2B is a side view of an aerosol dispenser.
Figure 2A:
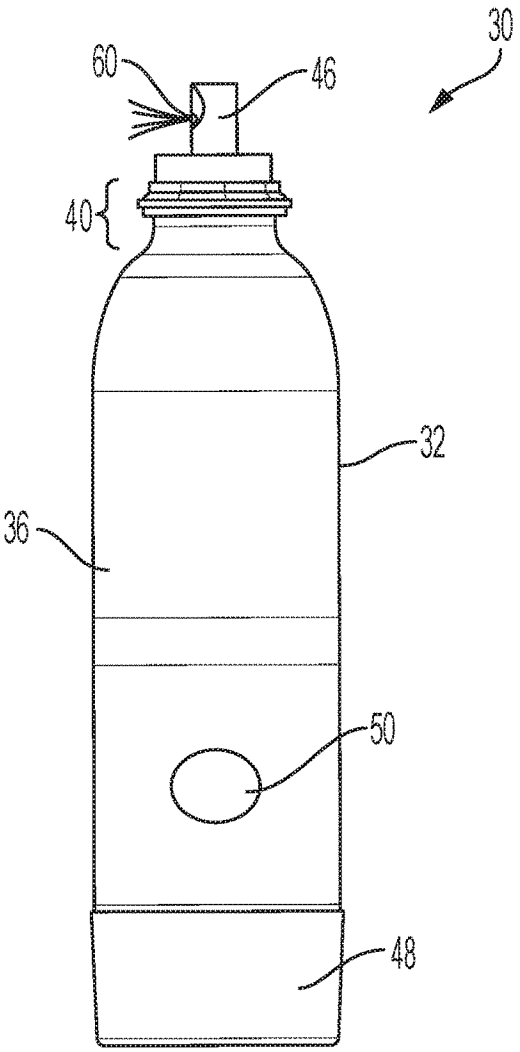
FIG. 2A is a side view of an aerosol dispenser.

The present disclosure is directed to a valve assembly and, more specifically, a valve assembly for a dispenser. The present disclosure describes the valve assembly used in an aerosol dispenser. However, the valve assembly may be used in a non-pressurized dispenser. An aerosol dispenser may include a container for containing a product and a propellant and a valve assembly for dispensing the product or the product and the propellant from the container. Other components may be included in the aerosol dispenser such as a nozzle for controlling the spray characteristics of a product as it is discharged from the aerosol dispenser and an actuator for selectively dispensing product from the aerosol dispenser. Products may include, but are not limited to: shave cream, shave foam, body sprays, body washes, perfumes, hair cleaners, hair conditions, hair styling products, antiperspirants, deodorants, personal and household cleaning or disinfecting compositions, air freshening products, fabric freshening products, hard-surface products, astringents, foods, paint, and insecticides.

The relatively large number of products that may be dispensed using aerosols has made aerosols a popular choice among manufacturing companies. The relative popularity of aerosol dispensers has resulted in companies considering cost cutting measures with respect to aerosol dispensers and to consider materials, at least in part, for aerosol dispensers to minimize the environmental impact. For example, an aerosol dispenser made from polymeric components may aid in the recyclability of the dispensers and help with reducing cost, such as by reducing the cost of manufacturing, eliminating expensive metal components, and reducing the cost of shipping, through weight reduction of each dispenser. The use of different materials also allows for greater flexibly in the size and shape of the dispenser. The present disclosure is directed to a valve that includes a valve assembly that may be accepted into a single recycling stream, such as the PET (polyethylene terephthalate) recycling stream, and safely vents at relatively excessive temperatures and/or pressures. Further, the valve assembly relatively minimizes the number of components used to seal product and/or propellant within the dispenser and to selectively dispense product and/or propellant.

With reference to FIGS. 2A, 2B, 3A, and 3B, an aerosol dispenser 30 may include a container 32, a valve assembly 52 (also referred to herein as a valve), a product delivery device 56, an actuator 46, and a nozzle 60. The container 32 may include a base cup 48 joined thereto and indicia 50 disposed on, for example, the sidewalls 36 of the container 32. The valve assembly 52 may be joined to a portion of the container 32. The term joined includes directly or indirectly joined. The term joined includes removably joined and fixedly joined. The term joined includes both mechanical attachment, such as by screws, bolts, interference fit, friction fit, welding, and integrally molding, and chemical attachment, such as by adhesive or the adhesive properties inherent in the materials being attached. The valve assembly 52 may be joined to the container such that a portion of the valve assembly 52 is disposed within the container. The product delivery device 56 may be joined to at least one of a portion of the container 32 and a portion of the valve assembly 52 and the product delivery device may be in fluid communication with the actuator 46 and the nozzle 60.

The base cup 48 may be joined to the bottom portion, which is opposite the valve assembly 52, of the container 32 and may be used, for example, to aid in positioning the dispenser on flat surfaces and to reinforce the bottom 34 of the aerosol dispenser. The container 32 may be configured to hold product and/or propellant. The product delivery device may be disposed at least partially within the container and the valve may be joined to the container 32 and may be in operative communication with the product delivery device. The product and/or the propellant may be stored in the container 32. Upon being dispensed, the product and/or propellant may travel from and/or through the product delivery device 56 and through the valve assembly 52.

The valve assembly 52 may be in fluid communication with a nozzle 60. The nozzle 60 directs product out of the aerosol dispenser and into the environment or onto a target surface. The nozzle may be configured in various different ways depending upon the desired dispensing and spray characteristics. The actuator 46 may be engaged by a user and is configured to initiate and terminate dispensing of the product and/or propellant. Stated another way, the actuator provides selective dispensing of the product and/or propellant. The actuator 46 may be depressible, operable as a trigger, push-button, and the like, to cause release of a product and/or propellant from the aerosol dispenser 30. The actuator 46 may include a connector such as a male or female connector, snap-fit connector, or the like to secure the actuator to the container. It is to be appreciated that to dispense product, the aerosol dispenser does not need to include an actuator and a nozzle. The product and/or propellant may be dispensed from the stem.

The container 32 may be used to hold product and/or propellant. The container 32 may be any shape that allows product and/or propellant to be held within the interior of the container. For example, the container may be peanut-shaped, oval-shaped, or rectangular-shaped. It is to be appreciated that the container 32 may be molded, which allows for any number of shapes to be used. The container 32 may be longitudinally elongate such that the container has an aspect ratio of a longitudinal dimension to a transverse dimension, such as diameter. The aspect ratio may be greater than 1, equal to 1, such as in a sphere or shorter cylinder, or an aspect ratio less than 1. The containers 32 may be cylindrical.

The container 32 may include a closed bottom 34, one or more sidewalls 36, and a neck 40. The one or more sidewalls 36 may extend between the closed bottom 34 and the neck 40. The sidewalls 36 define the shape of the container 32. A shoulder 42 may be included between the neck 40 and the one or more sidewalls 36. The neck 40 of the container 32 may define an opening 38. The opening 38 may be opposite the bottom 34 of the container 32. The neck 40 and/or shoulder 42 may have a uniform or varying thickness and/or crystallinity in order to achieve a desired strength in these regions of the container 32.

The bottom 34 of the container 32 may be configured for resting on horizontal surfaces such as shelves, countertops, tables etc. The bottom 34 of the container 32 may include a re-entrant portion or base cup 48. The base cup 48 may be joined to the bottom 34 of the container 32 and may aid in reinforcement of the bottom 34 and/or may allow the container to rest on horizontal surfaces. The container 32 may not include a base cup and may be configured to sit on at least a portion of the bottom 34. Suitable shapes of the bottom 34 include petaloid, champagne, hemispherical, or other generally convex or concave shapes. Each of these shapes of the bottom 34 may be used with or without a base cup 48. The container 32 may have a generally flat base with an optional punt.

The container 32 may be polymeric. The container 32 may include polyethylene terephthalate (PET), polyethylene furanoate (PEF), polyester, nylon, polyolefin, EVOH, or mixtures thereof. The container may be a single layer or multi-layered. The container 32 may be injection molded and/or blow molded, such as in an injection-stretch blow molding process or an extrusion blow molding process.

The container 32 may be axisymmetric as shown, or, may be eccentric. The cross-section may be square, elliptical, irregular, etc. Furthermore, the cross section may be generally constant as shown, or may be variable. For a variable cross-section, the container may be, for example, barrel shaped, hourglass shaped, or monotonically tapered.

The container 32 may range from about 6 cm to about 60 cm, or from about 10 cm to about 40 cm in height, taken in the axial direction. The container 32 may have a cross-section perimeter or circumference, if a round cross-section is selected, from about 3 cm to about 60 cm, or from about 4 cm to about 10 cm. The container may have a volume ranging from about 40 cubic centimeters to about 1000 cubic centimeters exclusive of any components therein, such as a product delivery device 56.

At 21° C., the container 32 may be pressurized to an internal gauge pressure of about 100 kPa to about 1500 kPa, or from about 110 kPa to about 1300 kPa, or from about 115 kPa to about 490 kPa, or about 270 kPa to about 420 kPa using a propellant. An aerosol dispenser 30 may have an initial propellant pressure of about 1500 kPa and a final propellant pressure of about 120 kPa, an initial propellant pressure of about 900 kPa and a final propellant pressure of about 300 kPa, or an initial propellant pressure of about 500 kPa and a final propellant pressure of 0 kPa.

The propellant may include hydrocarbons, compressed gas, such as nitrogen and air, hydro-fluorinated olefins (HFO), such as trans-1,3,3,3-tetrafluoroprop-1-ene, and mixtures thereof. Propellants listed in the US Federal Register 49 CFR 1.73.115, Class 2, Division 2.2 may be acceptable. The propellant may be condensable. A condensable propellant, when condensed, may provide the benefit of a flatter depressurization curve at the vapor pressure, as product is depleted during usage. A condensable propellant may provide the benefit that a greater volume of gas may be placed into the container at a given pressure. Generally, the highest pressure occurs after the aerosol dispenser is charged with product but before the first dispensing of that product by the user.

Figure 3B:
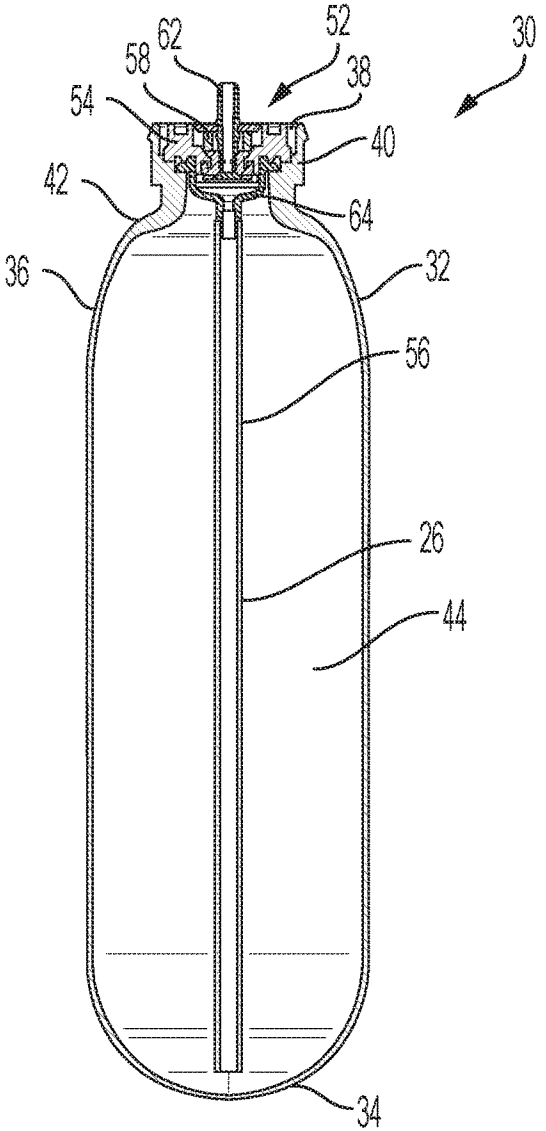
FIG. 3B is a sectional view of an aerosol dispenser including a dip tube.
Figure 3A:
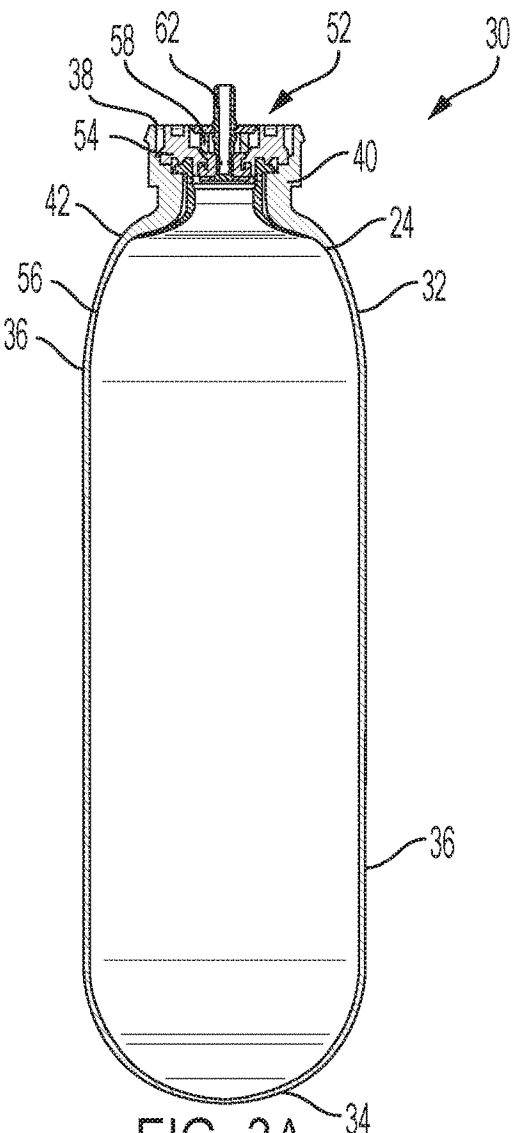
FIG. 3A is a sectional view of an aerosol dispenser including a bag.

The product delivery device 56 may be used to contain and/or provide for delivery of product and/or propellant from the aerosol dispenser 30 upon demand. Suitable product delivery devices 56 comprise a piston, a bag 24, or a dip tube 26, such as illustrated in FIGS. 3A and 3B. The product delivery device 56 may include polyethylene terephthalate (PET), polypropylene (PP), polyethylene furanoate (PEF), polyester, nylon, polyolefin, EVOH, or mixtures thereof. The container may be a single layer or multi-layered. The bag 24 may be disposed within the container 32 and be configured to hold a product therein, such as illustrated in FIG. 3A. Propellant may be disposed within the container 32 and/or between the container and the bag 24. A portion of the bag 24 may be joined to at least one of the container 32 and a portion of the valve assembly 52, such as the valve body 54. The bag 24 may be positioned between the container 32 and the valve body 54. The bag 24 may be inserted into the container 32 and subsequently joined thereto. The bag 24 may be joined to the valve body 54, and the valve body 54 may be subsequently inserted into the container 32.

As illustrated in FIG. 3B, the dispenser may include a dip tube adaptor 64 and a dip tube 26. The dip tube adaptor 64 may be disposed within the container 32. The dip tube adaptor 64 may engage a portion of the neck 40. The dip tube 26 may be joined to the dip tube adaptor 64 and extend from the dip tube adaptor 64 toward the bottom 34 of the container 32. It is to be appreciated that the dip tube 26 may be attached directly to a portion of the valve assembly, such as the valve body 54. The dip tube 26 and/or the dip tube adaptor 64 may be attached to the valve body 54 prior to being disposed within the container. The dip tube 26 and/or the dip tube adaptor 64 may be disposed within the container and then subsequently joined to a portion of the container and/or the valve body 54.

The product delivery device 56 may include a metering device for dispensing a pre-determined, metered quantity of product. The product delivery device 56 may include an inverting valve such as a valve including a ball therein to alter the path of product flow. The product delivery device 56 may include a dip tube disposed in a bag. The product delivery device 56 may be polymeric.

Figure 3E:
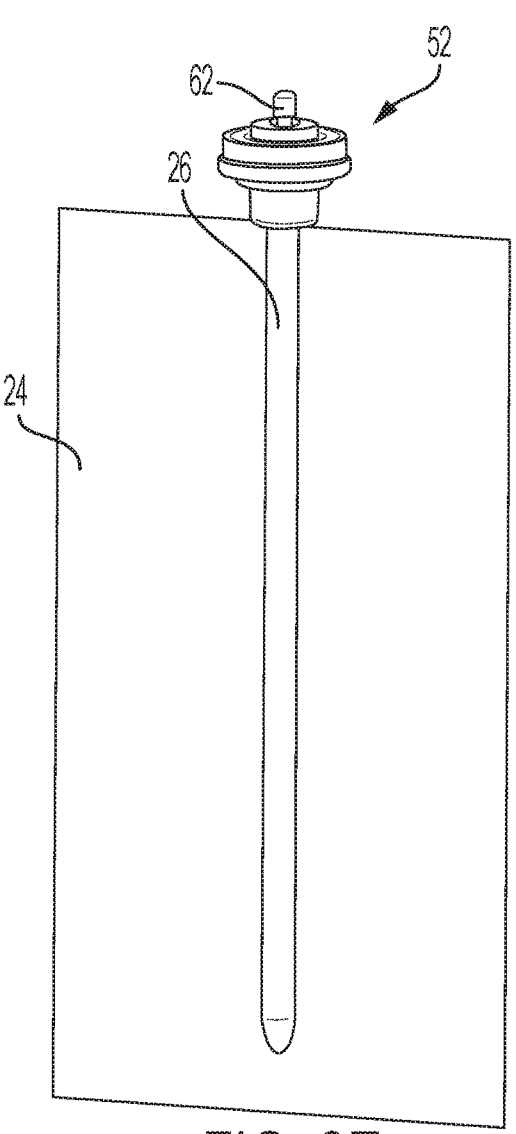
FIG. 3E is a perspective view of a dip tube joined to a valve assembly and an extended bag.
Figure 3D:
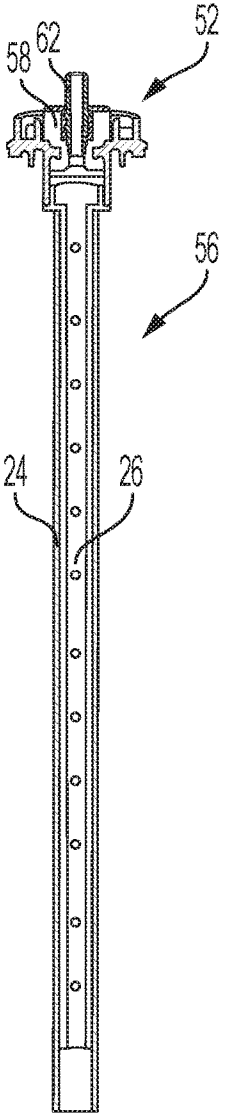
FIG. 3D is a sectional view of a dip tube joined to a valve assembly and a bag wrapped about the dip tube.
Figure 3C:
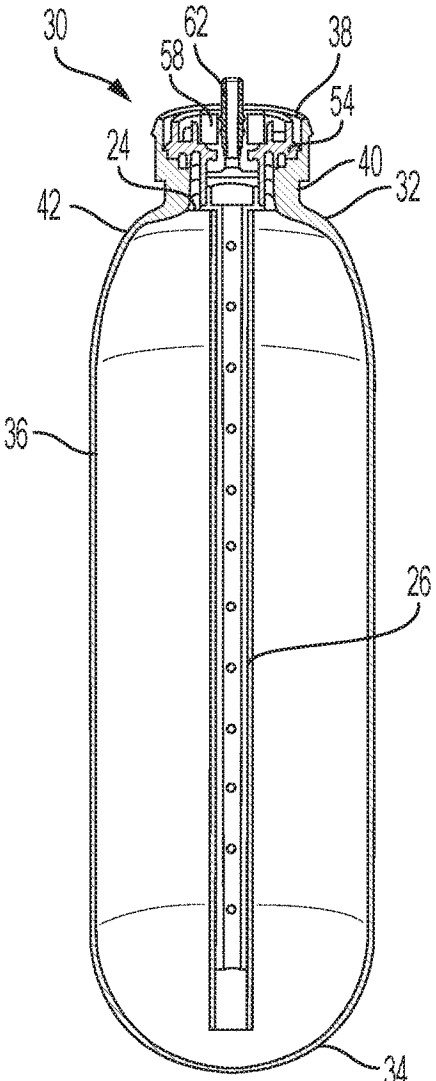
FIG. 3C is a sectional view of an aerosol dispenser including a bag and a dip tube.

Referring to FIGS. 3C-3E, the product delivery device 56 may include a dip tube 26 and a bag 24. The bag 24 may be attached to a portion of the dip tub 26 and the dip tube may be disposed within the bag 24. The dip tube 26 may include one or more orifices through which product may flow. A portion of the dip tube 26 may be joined to a portion of the valve assembly 52. A portion of the dip tube 26 may be joined to a portion of the valve body 54. The dip tube 26 may be joined to a portion of the valve body 54 by friction fit, snap fit, chemical attachment, such as by adhesive, or mechanical attachment, such as by a weld, screw, or nail. Prior to the valve assembly 52, the dip tub 26, and the bag 24 being joined to the container 32, the bag 24 may be wrapped about the dip tub 26, such as illustrated in FIG. 3D, or collapsed in some other manner such that the bag 24 does not interfere as the dip tube 26 and bag 24 are inserted into the container 32. Once the bag 24 and dip tube 26 are disposed within the container 32, the bag 24 may expand within the container.

The container 32, and/or the product delivery device 56 may be transparent or substantially transparent. This arrangement provides the benefit that the consumer knows when product is nearing depletion and allows improved communication of product attributes, such as color, viscosity, etc. Also, indicia disposed on the container, such as labeling or other decoration of the container, may be more apparent if the background to which such decoration is applied is clear. Labels may be shrink wrapped, printed, etc., as are known in the art.

The container 32 may include a neck 40. The neck 40 may define an opening 38 and be configured to receive a valve assembly 52. The valve assembly 52 may be disposed on or inserted, at least partially, into the opening 38 of the neck 40 of the container 32, such as illustrated in FIGS. 3A, 3B, and 3C. The valve assembly 52 may include a valve body 54, a valve stem 62, and a resilient member 58. At least a portion of the valve assembly 52 may be movable in relationship to the balance of the aerosol dispenser in order to open and close the aerosol dispenser for dispensing product and/or propellant. The valve assembly 52 may be opened due to movement of the valve stem 62 which may be through use of an actuator 46 or through manual or other mechanical movement of the valve stem 62. When the valve 52 is opened, for example, by way of the actuator 46, a flow path is created for the product to be dispensed through a nozzle 60 to ambient or a target surface. The valve assembly 52 may be opened, for example, by selective actuation of the actuator 46 by a user.

A portion of the valve body 54 may be sealed to the neck of the container 32, such as illustrated in FIGS. 3A, 3B, and 3C, to prevent the escape of product and/or propellant. The valve body 54 may be sealed to the container 32 utilizing a press fit, interference fit, crimping, solvent welding, laser welding, sonic welding, ultrasonic welding, spin welding, adhesive, or any combination thereof, so long as a seal adequate to contain the product and/or to maintain the pressure results. The valve body 54 may be joined to the container 32 such that at least a portion of the valve body 54 is disposed within the container 32. The valve body 54 may be joined to the container 32 such that the valve body 54 is joined to the opening of the neck.

Figure 4:
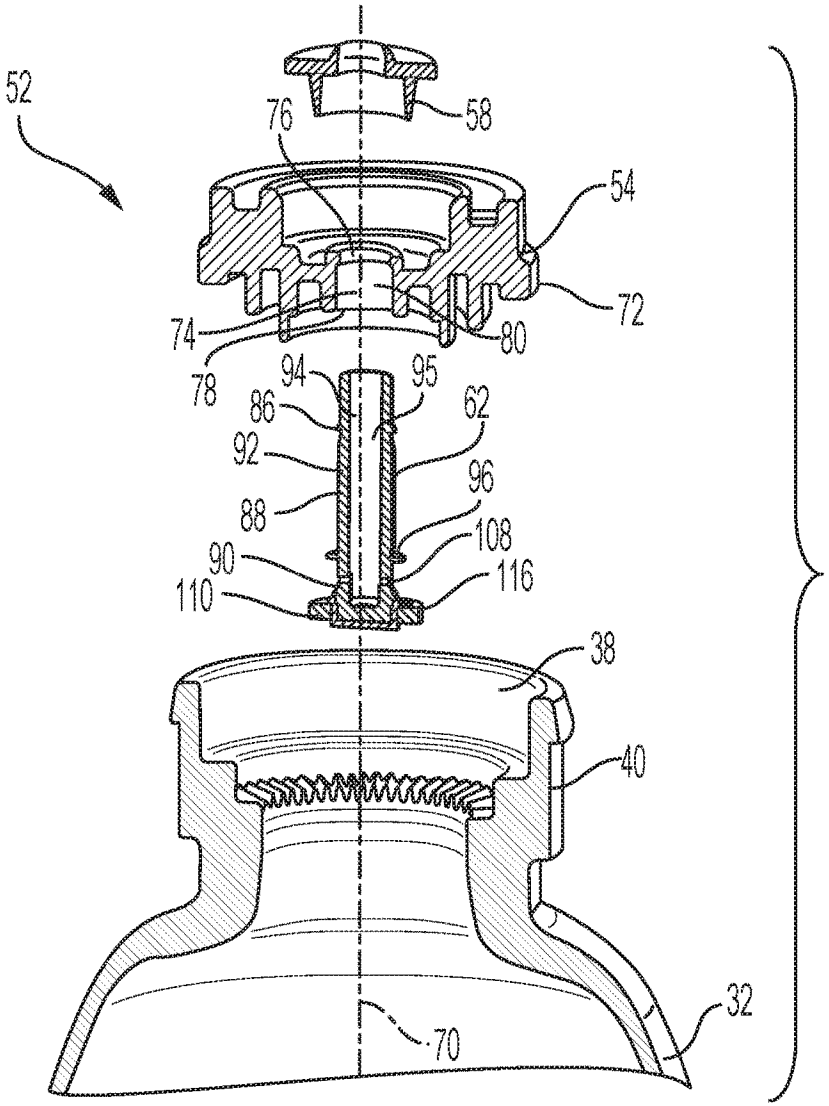
FIG. 4 is a partial, exploded, sectional view of a valve.

As illustrated in FIG. 4, the valve body 54 may extend about a longitudinal axis 70. The valve body 54 may include an outer surface 72 and define an inner passageway 74. The inner passageway 74 may include a first passageway opening 76 and a second passageway opening 78 and a passageway surface 80 extending from the first passageway opening 76 to the second passageway opening 78. The passageway surface 80 may substantially surround the longitudinal axis 70.

A valve stem 62 may extend through the inner passageway 74 of the valve body 54. The valve stem 62 provides a product flow path from the interior of the container to the nozzle 60 and operatively joins the actuator 46 to the valve assembly 52. The valve stem 62 may be positioned with respect to the valve body 54 such that a first portion 86 of the valve stem 62 may be adjacent to the first passageway opening 76 of the valve body 54, a second portion 88 of the valve stem 62 may be substantially surrounded by the passageway surface 80, and a third portion 90 of the valve stem 62 may be adjacent to the second passageway opening 78 of the valve body 54. The valve stem 62 may be positioned with respect to the valve body 54 such that a first portion 86 of the valve stem 62 extends through the first passageway opening 76 of the valve body 54, a second portion 88 of the valve stem 62 may be substantially surrounded by the passageway surface 80, and a third portion 90 of the valve stem 62 extends through the second passageway opening 78 of the valve body 54. The valve stem 62 may be moveable with respect to the valve body 54. Thus, the valve stem 62 may be positioned in other configurations as the valve stem 62 moves. The valve stem 62 may include an outer stem surface 92 and an inner stem surface 94 opposite the outer stem surface. The inner stem surface 94 may define a channel 95 through which product and/or propellant may flow. The valve stem 62 may include a fin 96 extending radially outward from the outer stem surface 92.

The valve assembly 52 may include a resilient member 58. The resilient member 58 may operatively engage a portion of the valve stem 62. More specifically, a portion of the resilient member 58 may engage a portion of the valve stem 62. The resilient member 58 may operatively engage a portion of the valve body 54. The resilient member 58 may be any compliant member that provides resistance to the movement of the valve stem 62, such as when the valve stem 62 is moved to a dispensing configuration or a filling configuration, and returns the valve stem 62 to a sealing configuration. The resilient member 58 may be made from at least one of a metal and a polymer. For example, the resilient member 58 may be made from a thermoplastic elastomer, silicone, rubber, or other polymeric material. The resilient member 58 may be any shape such that the resilient member 58 operatively engages the valve stem and/or controls the movement of the valve stem. The resilient member 58 may generally have a cross-sectional shape of a circle, square, rectangle, ellipse, trapezoid, parallelogram, triangle, gear, or any other shape that fits with the valve body and delivers the desired control over the movement of the valve stem. The resilient member 58 may include one or more notches and apertures.

The resilient member 58 may be made from a resilient polymeric material such as a thermoset material, a thermoplastic material, or a plastomer. The resilient polymeric material may include a non-cross-linked material. The resilient polymeric material may include a melt-processible material. The thermoplastic material may contain cross-linked polymer chains that remain melt processible. The resilient member may be made entirely from one or more non-cross-linked resilient polymeric materials. The resilient member may be made entirely from one or more melt-processible resilient polymeric materials. The resilient polymeric material may be modified such as by means of additives or by foaming to alter its properties.

The resilient member may comprise one or more thermoplastic elastomers (TPE). The thermoplastic elastomer may include styrenic block copolymers (TPS), thermoplastic polyolefin elastomers (TPO), thermoplastic elastomer vulcanizates (TPV), thermoplastic polyurethane elastomers (TPU), thermoplastic copolyester elastomers (TPC), thermoplastic polyamide elastomers (TPA), non-classified thermoplastic elastomers (TPZ), and combinations thereof.

To aid with recyclability of the container, the resilient member may include at least one of a non-cross-linked material and a melt-processible material or the resilient member may be made entirely from one or more non-cross-linked, melt-processible materials. Further, the resilient member 58 may have a density that would allow the resilient member 58 to be float-separable during a recycling process. The resilient member 58 may have a density less than 1.0 g/cc.

The valve stem 62 may include one or more fins 96, such as illustrated in FIGS. 4, 5A-5D. The fin 96 may be joined to the outer stem surface 92. More specifically, each fin 96 may include a root portion 98 and a tip portion 100, which is opposite the root portion 98. The root portion 98 may be joined to the outer stem surface 92 and the tip portion 100 may be positioned outward, such as radially outward, from the outer stem surface 92. The fin 96 may have a fin length FL measured along the surface of the fin as the shortest distance between the point where the root portion engages the outer stem surface 92 to the outermost point of the tip portion 100. The fin length FL may be any length such that a seal is formed between a portion of the fin 96, such as a tip portion 100 or an intermediate portion 99 of the fin 96, and the passageway surface 80 of the valve body 54. The fin length FL may be from about 0.1 mm to about 15 mm or from about 0.5 mm to about 12 mm or from about 1 mm to about 10 mm, including all 0.1 mm within the recited ranges and all ranges formed therein or thereby. The fin 96 may have a uniform thickness or varying thickness along the fin length FL. For example, the root portion 98 may be thicker than the tip portion 100. The root portion 98 may have a greater thickness than the tip portion 100 to accommodate the forces exerted on the fin 96 when the tip portion 100 operatively engages the passageway surface 80 forming a seal therebetween.

The fin 96 may be made from one or more materials. For example, the root portion 98 of the fin 96 may be made from a first material and the tip portion 100 may be made from a second material. The first material and the second material may be different. The tip portion 100 of the fin 96 may be coated with a material and this coating material may be the same or different than the materials used for the other portions of the fin 96, such as the first and second materials. Stated another way, an additional material may be disposed on the tip portion 100 of the fin 96. The material coating the tip portion 100 may be used to increase or decrease friction between the tip portion 100 and the passageway surface 80 as the fin 96 moves with respect to the valve body 54. The material coating the tip portion 100 may be added to reduce wear and thus, prolong the life of the fin 96. Materials that may be used to coat the tip portion 100 may include, but are not limited to: elastomers, polymers, greases, oils, silicones, and lubricants. The tip portion 100 may also be treated to affect the friction between the tip portion 100 and the passageway surface 80. Treatments may include, but are not limited to, polishing, crystallization, corona-treatment, or cross-linking.

Figure 5B:
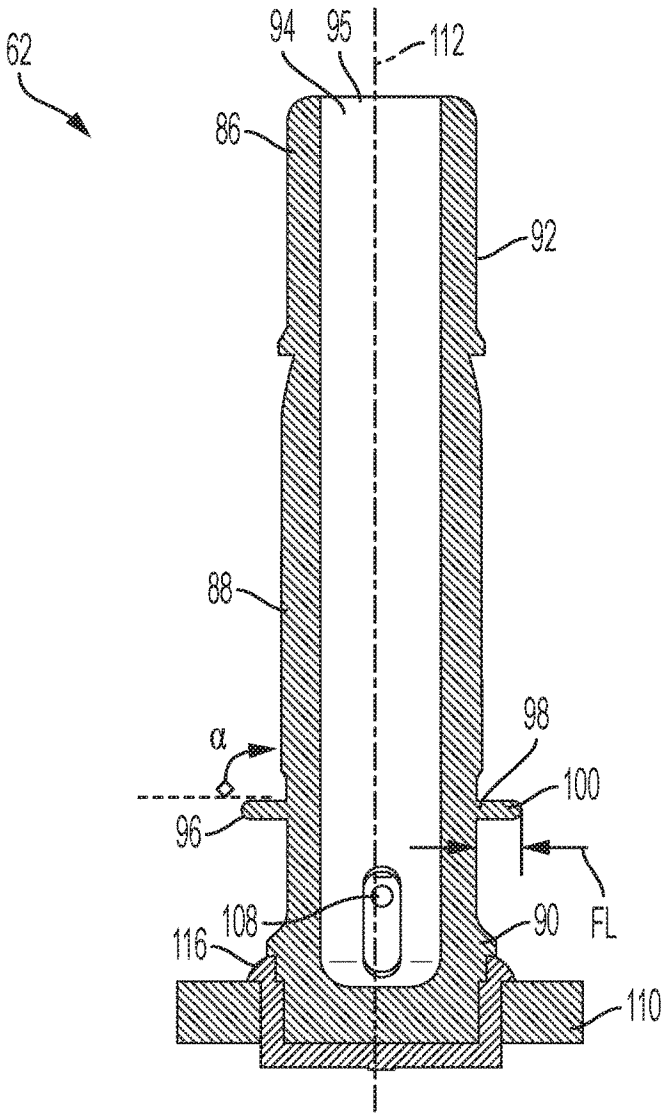
FIG. 5B is a sectional, side view of a valve stem.
Figure 5A:
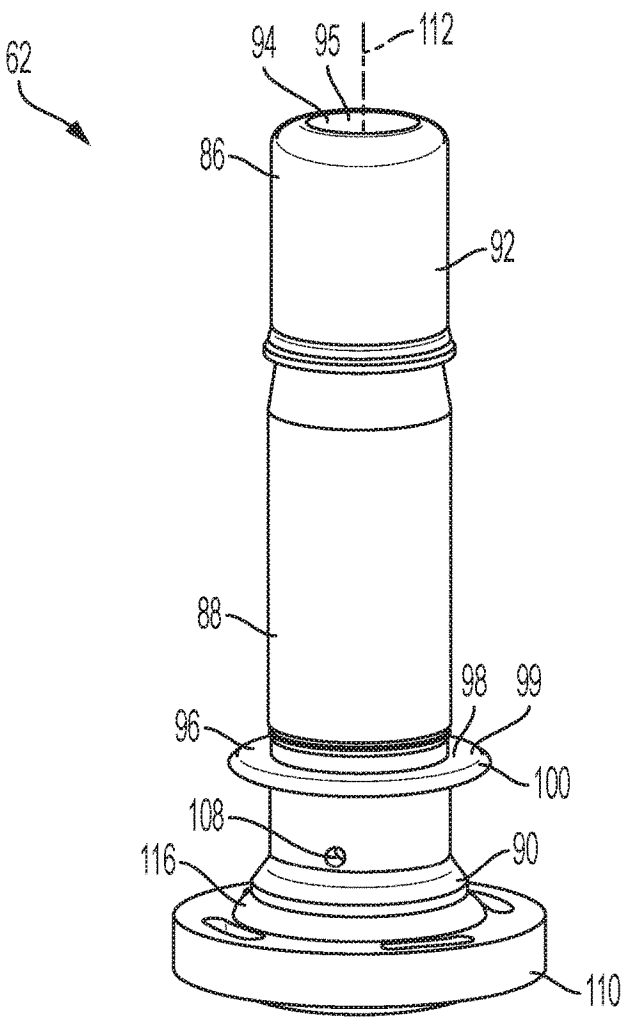
FIG. 5A is a side, elevation view of a valve stem.
Figure 5D:
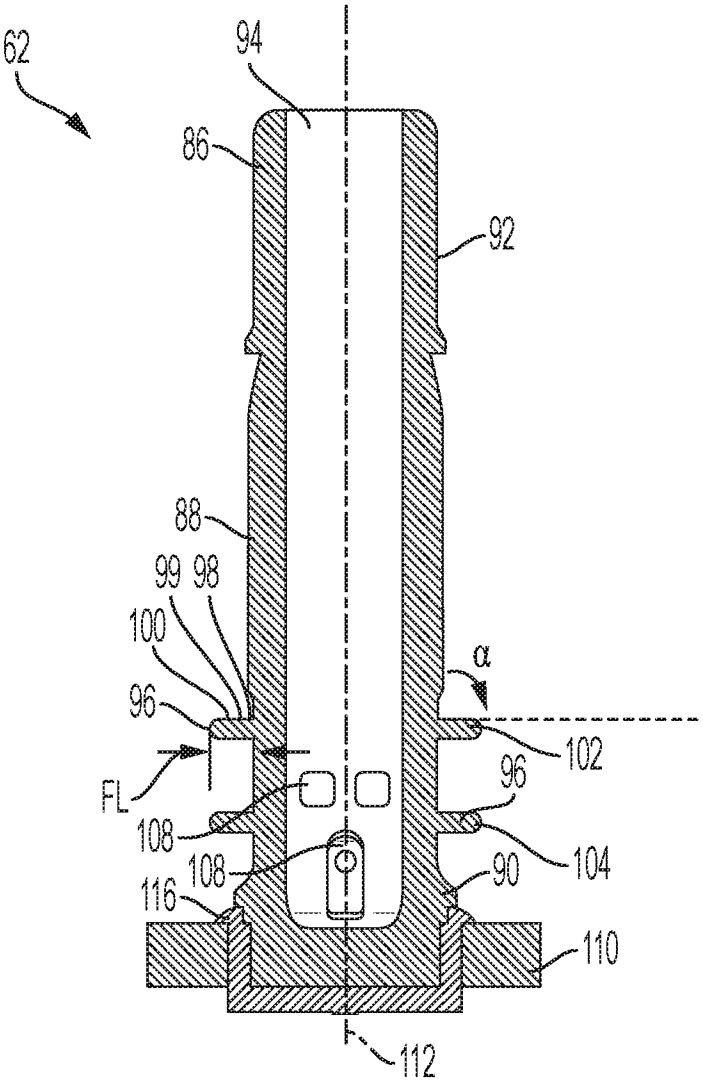
FIG. 5D is a sectional, side view of a valve stem.
Figure 5C:
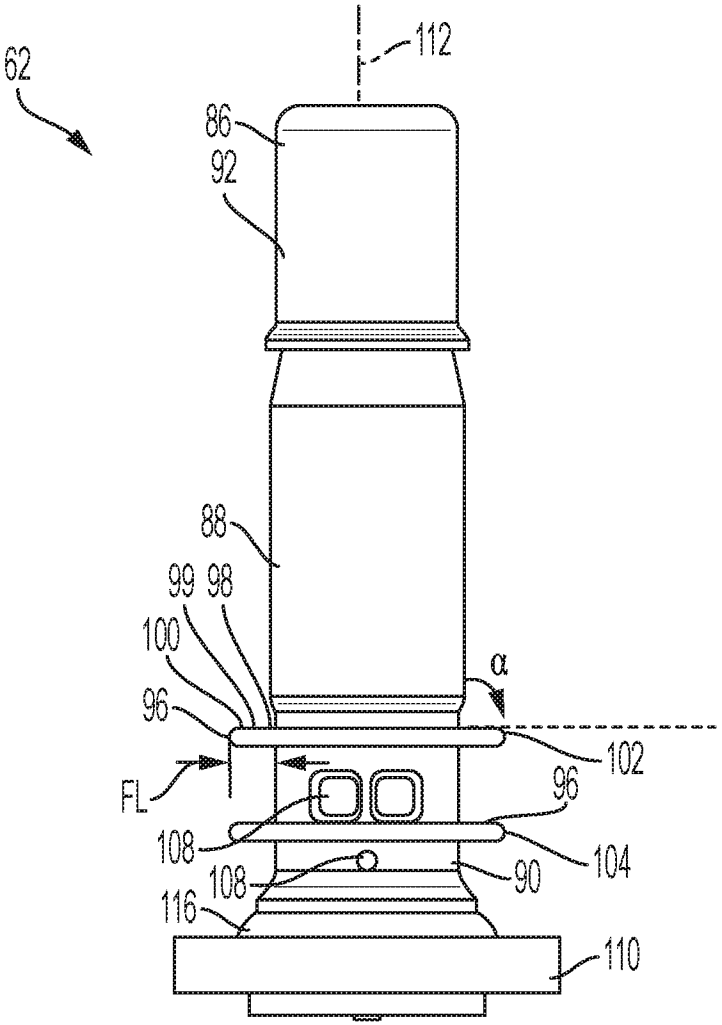
FIG. 5C is a side, elevation view of a valve stem.

The valve stem 62 may be manufactured, such as by molding, with one or more fins 96. The valve stem 62 may be manufactured with the fin 96 at a pre-engagement angle $\alpha$ measured clockwise from the outer stem surface 92 to the surface of the fin 96, as illustrated in FIGS. 5A-5C. The pre-engagement angle $\alpha$ may be from about 5 degrees to about 179 degrees or from about 10 degrees to about 145 degrees or from about 15 degrees to about 120 degrees or from about 45 degrees to about 115 degrees or from about 65 degrees to about 95 degrees or from about 75 degrees to about 90 degrees, including all 0.1 degrees within the recited ranges and all ranges formed therein or thereby. For example, as illustrated in FIGS. 5A-5C, the pre-engagement angle $\alpha$ may be about 90 degrees. The pre-engagement angle $\alpha$ may be determined, in part, based on the material(s) of the fin 96 and the clearance between the valve stem 62 and the valve body 54.

The valve stem 62 may include any number of fins 96 necessary to maintain a seal between the valve stem 62 and the valve body 54. For example, a valve stem 62 may include a first fin 102 and a valve seal 116 or a valve stem 62 may include a first fin 102, a second fin 104, and a valve seal. The second fin 104 may be positioned between the first fin 102 and the valve seal 116. As illustrated in FIGS. 5A and 5B, a valve stem 62 may include a first fin 102 and a valve seal 116.

The valve stem 62 may include a third portion 90, opposite the first portion 86. The third portion 90 of the valve stem 62 may include a retaining member 110. The retaining member 110 may be joined to the third portion 90 or the retaining member 110 may be formed with the remainder of the valve stem 62. The retaining member 110 may be formed from the same material as the other portions of the valve stem 62 or with a different material. For example, the retaining member 110 may be formed with a first material and the remainder of the valve stem 62 may be formed with one or more other materials that are different than the first material. The first material may have a melting point or a glass transition temperature (Tg) that is lower than the one or more other materials to allow the first material of the retaining member 110 to soften and deflect at a given temperature that is lower.

The retaining member 110 may extend outward, such as radially outward, beyond the outer stem surface 92 and may be configured to engage a portion of the valve body 54. The retaining member 110 may work in cooperation with the resilient member 58 to position the valve stem 62 in a sealing configuration. The retaining member 110 may be any shape such that a portion of the retaining member 110 may operatively engage a portion of the valve body 54. The shape of the retaining member 110 may be such that the retaining member 110 maintains the position of the valve stem 62 during safe operating conditions and aids in retaining the valve stem so as to safely vent the container during adverse operating conditions, such as relatively elevated temperatures and/or over pressurization of the aerosol dispenser.

The valve stem 62 may include one or more orifices 108. The orifices 108 may be used for filling the container with product and/or propellant and/or dispensing product and/or propellant from the container. The one or more orifices 108 may be any shape or size so long as product and/or propellant may be filled and/or dispensed through such orifices. For example, the one or more orifices may be circular, oval, rectangular, square, or any other shape. For a valve stem 62 including two or more orifices, each of the orifices may be the same or different shapes and may be the same or different sizes. The orifice 108 may extend from the outer stem surface 92 to the inner stem surface 94. The orifice 108 may be in fluid communication with the channel 95 defined by the inner stem surface 94 such that product and/or propellent may flow through the orifice and into the channel 95. The product and/or propellant may flow from the container, through the orifice, and into the channel 95. The product and/or propellant may also flow through the channel, through the orifice, and into the container.

The valve assembly 52 may include a valve seal 116. As illustrated in FIG. 5A-5D, the valve seal 116 may be joined to a portion of the valve stem 62. For example, the valve stem 62 may include a fin 96 joined to the outer stem surface 92 and a valve seal 116 joined to the outer stem surface 92. The valve seal 116 may be joined to one of the first portion 86, the second portion 88, or the third portion 90 of the valve stem 62. For example, the valve seal 116 may be joined to the valve stem 92 such that the valve seal 116 is disposed on the third portion 90 of the valve stem 62. The valve seal 116 may be molded into position or attached, such as through the adhesive-like properties of the material of the valve seal 116 or the valve seal 116 may be separately manufactured and subsequently inserted such that it is joined to at least a portion of the valve stem 62. The valve seal 116 may be made from any material that provides a seal between the valve seal 116 and the valve body 54. The valve seal 116 may be made from one or more materials including thermoplastic elastomers (TPE), silicone, rubber, or polymers, which may be foamed. For increased sustainability, the valve seal 116 may be made from a material such that when the aerosol dispenser is processed for recycling, the valve seal 116 separates from the valve stem 62. The valve seal 116 may be positioned such that the valve seal 116 forms a second seal with a portion of the valve body 54. The valve seal 116 may be configured to move with the valve stem 62.

As previously discussed, a retaining member 110 may be joined to the valve stem 62. The valve seal 116 may be positioned between the valve stem 62 and the retaining member 110, such as illustrated in FIGS. 5A and 5B. A portion of the valve seal 116 may extend beyond the upper surface of the retaining member such that the valve seal 116 may operatively engage a portion of the valve body 54 to form a second seal. Alternatively, the retaining member 110 or at least a portion thereof may be joined directly to the valve stem 62. The valve seal 116 may then be joined to at least one of the outer surface of the valve stem and a surface of the retaining member 110. The valve seal 116 may be disposed on a portion of the retaining member 110.

The fin 96 and/or the valve seal 116 may be positioned such that the release of product and/or propellant through the one or more orifices 108 is controlled. To control the release of fluid, such as product and/or propellant, from the container through the orifice 108, a seal is formed that isolates the orifice and the product and/or propellant. Stated another way, a seal is formed between the fluid and the orifice 108. The orifice 108 may be positioned between the first portion 86 of the valve stem 62 and a fin 96, such that the fin creates a seal with the passageway surface. Stated another way, the one or more orifices 108 may be positioned such that at least one fin is located between the orifice and the third portion 90 of the valve stem 62 to prevent product and/or propellant from freely flowing from the container and through the orifice. The fin positioned between the orifice and the third portion prevents product and/or propellant from flowing to the orifice prior to the valve stem being moved to a dispensing configuration. When the valve stem is in a sealing configuration, the fin prevents product and/or propellant from accessing the orifice and contains the product and/or propellant within the container. A second fin may be located between the orifice and the first portion 86 of the valve stem to prevent product and/or propellant from freely flowing through the inner passageway 74 and out the first passageway opening 76 as product and/or propellant flow through the orifice.

Further, the orifice 108 may be positioned between the fin 96, such that the fin creates a seal with the passageway surface, and the valve seal 116, such that the valve seal creates a seal with a portion of the valve body 54. Stated another way, the one or more orifices 108 may be positioned such that the valve seal 116 is located between the orifice and the product and/or propellant, which prevents the product and/or propellant from freely flowing from the container and through the orifice. The valve seal prevents product and/or propellant from flowing to the orifice prior to the valve stem being moved to a dispensing configuration. When the valve stem is in a sealing configuration, also referred to herein as a sealed configuration, the valve seal prevents product and/or propellant from accessing the orifice and contains the fluid, which may include product and/or propellant, within the container. The fin may be located between the orifice and the first portion 86 of the valve stem to prevent product and/or propellant from freely flowing through the inner passageway 74 and out the first passageway opening 76 as fluid flows through the orifice. The valve seal 116 may prevent fluid from reaching the orifice 108 in the sealing configuration, and the fin 96 may be used to prevent fluid from passing beyond the portion of the valve stem with the orifice and/or the portion of the valve stem with the fin 96 when the valve stem is in the dispensing configuration.

One or more orifices may be positioned between the fin 96 and the valve seal 116. Similarly, one or more orifices may be positioned between a second fin and the fin 96. Positioning the orifices between seals, created either by a fin or a valve seal, may provide a more robust seal and may allow for selective filling and/or dispensing of the product and/or propellant, as will be described in detail herein.

Figure 6:
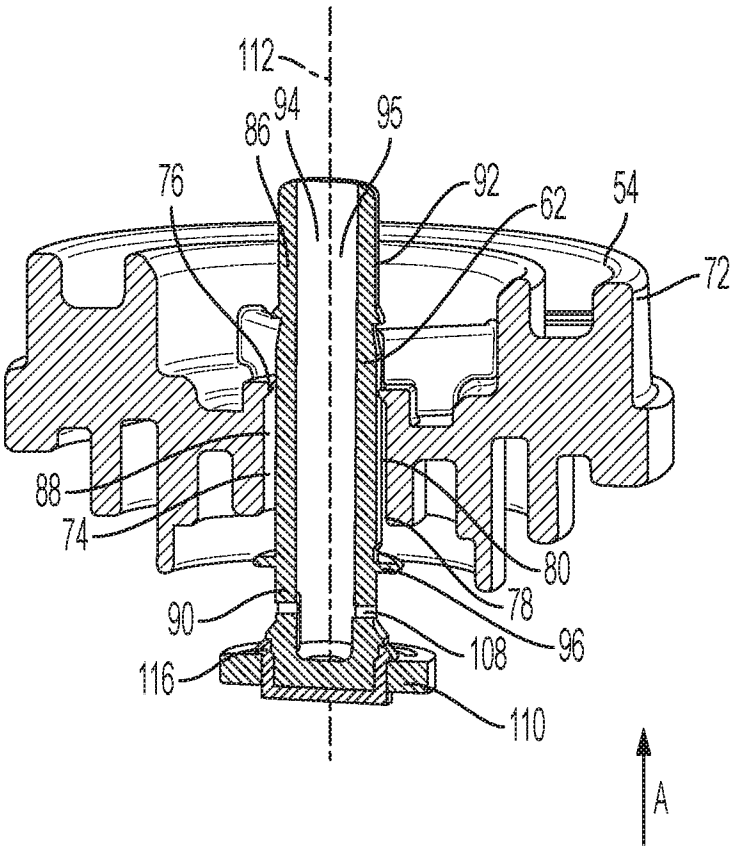
FIG. 6 is a perspective, sectional view of a valve body and a valve stem.

The valve stem 62 may be inserted into the valve body 54. The valve stem 62 may be inserted into the valve body 54 in the direction shown by arrow A, as illustrated in FIG. 6.

Prior to the valve stem 62 being inserted into the valve body 54, the one or more fins 96 may be oriented at a pre-engagement angle α, such as previously discussed. The pre-engagement angle α may be the same for two or more fins or may be different for two or more fins. As the valve stem 62 is inserted into the valve body 54, a portion of the fin 96 operatively engages the passageway surface 80 of the valve body 54. The distance from the longitudinal stem axis 112 to the tip portion 100 of the fin 96 may be greater than the distance from the longitudinal stem axis 112 to the passageway surface 80 of the valve body 54 before the valve stem 62 is inserted into the valve body 54. It is to be appreciated that the radial distance from the longitudinal stem axis 112 to the tip portion 100 of the fin 96 may be substantially equal to the radial distance from the longitudinal stem axis 112 to the passageway surface 80 of the valve body 54 as long as a seal may be formed upon operative engagement of the fin 96 and the passageway surface 80.

The fin 96, including the fin tip portion 100, may have any shape. As previously discussed, the fin 96 may be tapered so that the root portion 98 is thicker than the tip portion 100. The taper from the root portion to the tip portion 100 may be linear or non-linear. The cross-section of the fin 96 may be concave or convex. The tip portion 100 and/or intermediate portion 99 may be shaped to increase contact between the portion of the fin 96 and the passageway surface 80. The tip portion and/or the intermediate portion 99 may include a taper-angle so that the cross-section of this portion is non-continuous. The taper-angle may be selected such as to maximize contact between the upper fin surface and the passageway surface when the fin is engaged with the passageway surface.

Figure 7:
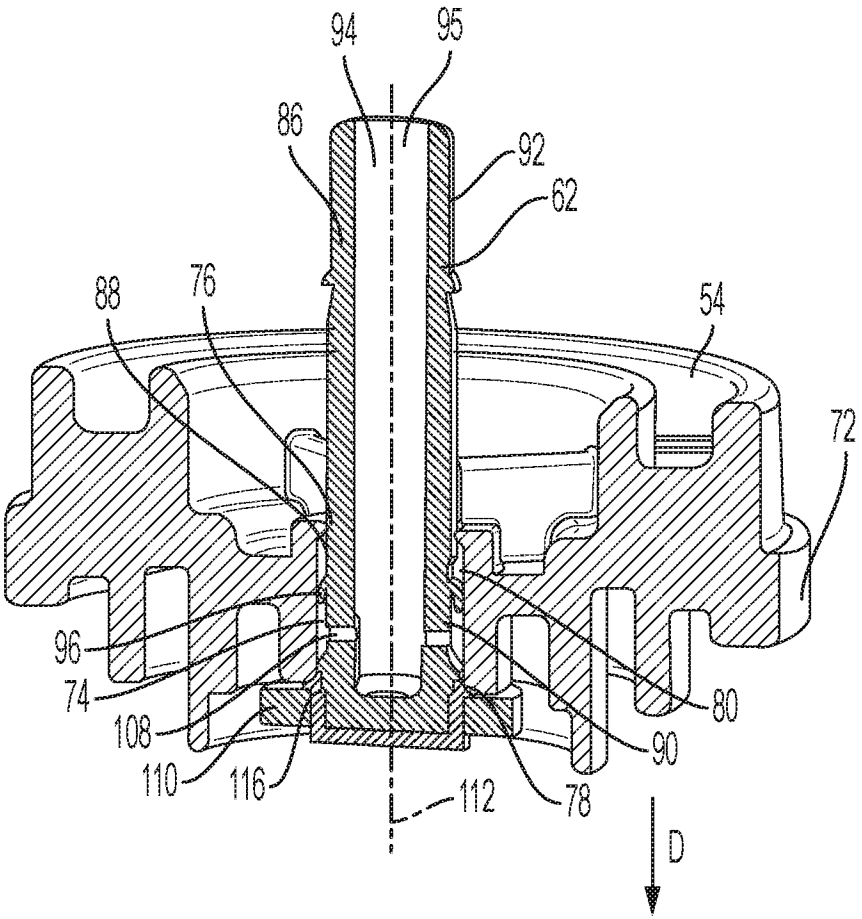
FIG. 7 is a perspective, sectional view of a valve body and a valve stem.

The fin 96 may deflect as the valve stem 62 is inserted into the valve body 54. The fin 96 may deflect in a direction opposite to the direction of insertion of the valve stem 62 into the valve body 54. For example, the valve stem may be inserted into the valve body in a direction indicated by arrow A and the fin 96 may deflect in a direction indicated by arrow D, as illustrated in FIG. 7. The tip portion 100 of the fin 96 operatively engages the passageway surface 80 of the valve body 54 to form a seal. The seal is configured to prevent escape of propellant and/or product through the valve assembly 52. When the valve stem 62 is positioned such that the fin 96 is operatively engaged with the passageway surface 80 of the valve body and forms a seal therebetween and the valve seal 116 operatively engages a portion of the valve body and forms a seal therebetween, the valve stem 62 is in a sealing configuration, such as illustrated in FIG. 7. In the sealing configuration, the retaining member 110 of the valve stem 62 may engage a portion of the valve body 54. It is to be appreciated that the seal formed by the valve seal 116 and the valve body prevents product and/or propellant from accessing the orifice.

It is to be appreciated that the amount of deflection of the fin 96 may result in other portions, in addition to the tip portion 100, of the fin 96 operatively engaging the passageway surface 80. For example, the intermediate portion 99 between the tip portion 100 and the root portion 98 may operatively engage the passageway surface 80. The tip portion 100 and the intermediate portion 99 of the fin 96 may operatively engage the passageway surface 80.

Figure 8B:
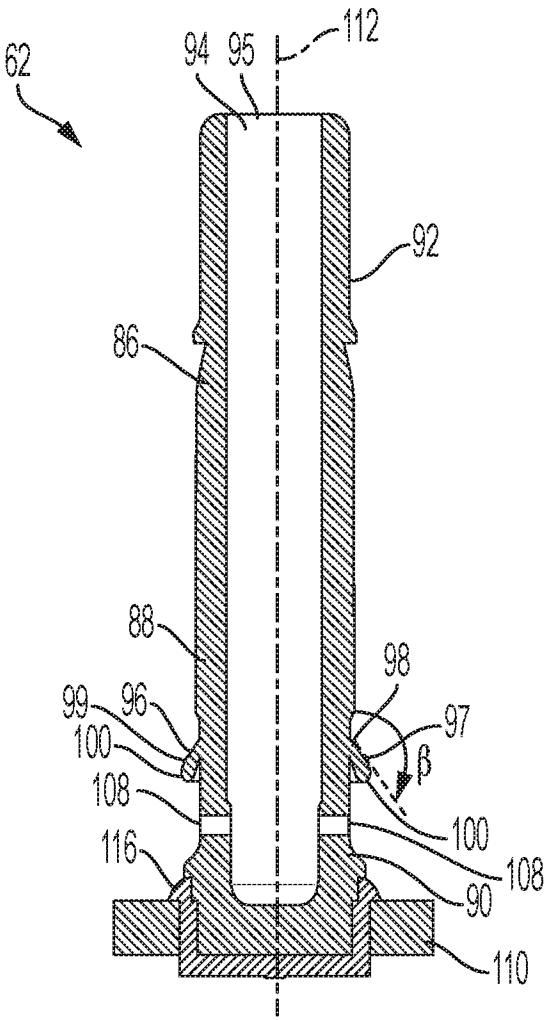
FIG. 8B is a sectional, side view of a valve stem.
Figure 8A:
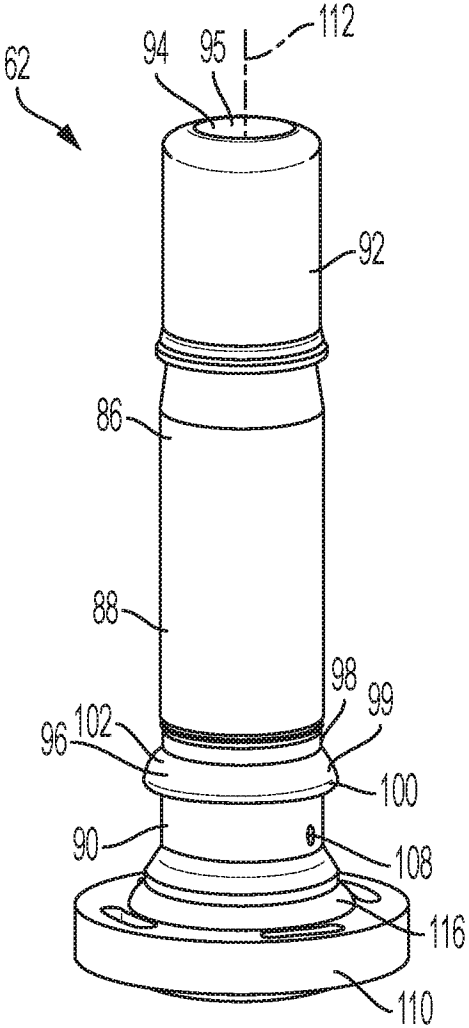
FIG. 8A is a side, perspective view of a valve stem.

FIGS. 8A and 8B illustrate a valve stem 62 after insertion into the valve body 54. The fin 96 deflects against the passageway surface 80. The amount of deflection may be due, in part, to the distance between the valve stem 62 and the passageway surface 80, the fin length, and the material(s) used to construct the fin 96. Upon insertion into the valve body 54, a fin 96 may have a post engagement angle β. The post engagement angle β may be measured clockwise from the outer stem surface 92 adjacent the root portion 98 to the fin 96. The post engagement angle β may be from about 5 degrees to about 180 degrees or from about 8 degrees to about 175 degrees or from about 10 degrees to about 145 degrees or from about 15 degrees to about 120 degrees or from about 45 degrees to about 115 degrees, including all 0.1 degrees within the recited ranges and all ranges formed therein or thereby. For example, as illustrated in FIGS. 8A and 8B, the post engagement angle β may be about 175 degrees. The post engagement angle β may be greater than about 90 degrees. It is to be appreciated that the pre-engagement angle α and the post engagement angle β may be the same or different. The pre-engagement angle α may be substantially equal to the post engagement angle β or the pre-engagement angle α may be less than the post engagement angle β.

It is to be appreciated that the fin 96 may deflect such that permanent deformation occurs and the fin 96 may remain in a substantially deflected position after removal of the valve stem 62 from the valve body 54. It is also to be appreciated that the fins 96 may return fully to their original position or partially to a position between their original position and the deflected position upon removal from the valve body 54.

Aerosol dispensers are pressurized, such as with propellant. Thus, the internal pressure of the container may aid in forming the seal between the passageway surface 80 and the fin 96 and the seal between the valve body 54 and the valve seal 116.

To dispense product and/or propellant from the container, a user may directly or indirectly, such as by use of an actuator, engage the valve stem 62 causing the valve stem 62 to move. Upon engagement, the valve stem 62 may move along the passageway surface 80 in a direction toward the interior 44 of the outer container. The valve stem 62 may move from a sealing configuration to a dispensing configuration. A sealing configuration is formed when fluid is prevented from flowing through the one or more orifices on the valve stem. A dispensing configuration is formed when fluid may flow through the one or more orifices on the valve stem. In a sealing configuration, the valve stem 62 is positioned such that a seal is maintained between the fluid and the orifice. In a dispensing configuration, the valve stem 62 is moved such that the seal formed between the fluid and the orifice on the valve stem is broken. For example, in a dispensing configuration, the seal formed by valve seal 116, which is positioned between the fluid and the orifice 108, is broken. Stated another way, the valve stem 62 may be moved such that the valve seal 116 loses engagement with the valve body 54 by being moved away from the valve body 54. Propellant and/or product may then flow through the orifice and into the channel 95. Upon disengagement of the valve stem 62, the valve stem 62 may move and the valve seal 116 may re-engage the valve body 54 to once again form a seal between the valve seal 116 and the valve body 54. Upon re-engagement of the seal, the valve stem is in a sealing configuration and, thus, fluid, such as product and/or propellant, may no longer flow to the orifice 108. It is to be appreciated that the dispensing configuration may also be used for filling.

As previously discussed, the valve stem 62 may include two or more fins 96 and one or more orifices positioned between each of the fins 96. As illustrated in FIGS. 5C and 5D, for example, the valve stem 62 may include a first fin 102 and a second fin 104. The first fin 102 may be positioned on the first portion 86 of the valve stem 62 or the second portion of the valve stem 88 and the second fin 104 may be positioned between the first fin 102 and the valve seal 116 disposed on the valve stem 62. One or more orifices 108 may be positioned between the first fin 102 and the second fin 104 and one or more orifices 108 may be positioned between the second fin 104 and the valve seal 116. In the sealing configuration, the first fin 102, the second fin 104, and the valve seal 116 are operatively engaged with the valve body 54, such as the passageway surface 80, such that a seal is formed between the valve body 54 and each of the first fin 102, the second fin 104, and the valve seal 116. It is to be appreciated that the valve stem may include a single fin.

As previously discussed, the valve stem 62 may move to allow product and/or propellent to be dispensed from or to be introduced to the container. The seal or lack thereof controls the introduction and dispersal of product and/or propellant. The amount of movement of the valve stem 62 may result in one or more of the seals between the fins and the passageway surface and the valve seal and the valve body breaking. More specifically, the valve stem 62 may be moved in a direction toward the interior of the container, such as indicated in FIG. 7 by arrow D, or in any direction that allows for the one or more seals to be broken. The valve stem 62 may be moved such that the second fin 104 becomes disengaged with the passageway surface 80, which breaks the seal between the second fin and the passageway surface. The disengagement may be due to the valve stem 62 extending beyond the second passageway opening 78 of the valve body 54 such that the second fin 104 no longer maintains a seal with the passageway surface 80.

The internal structure of the passageway surface 80 of the valve body 54 may also be such that the second fin 104 no longer maintains a seal with the passageway surface 80. The internal structure of the passageway surface 80 may include, for example, one or more grooves extending into the passageway surface 80 or one or more ridges protruding from the passageway surface 80 to interrupt the engagement of the fin and the passageway surface. The shape of the grooves and ridges may provide for gradual or abrupt flow of product and/or propellant. For example, the grooves and ridges may be tapered to, for example, gradually allow for increasing flow of product and/or propellant.

It is to be appreciated that the valve stem 62 may only be moved such that the valve seal 116 longer maintains a seal with the valve body, but the second fin and the first fin may maintain engagement with the passageway surface 80 and, thus, maintain a seal. Disengagement of the valve seal 116, allows product and/or propellant to flow into the orifice positioned between the valve seal 116 and the second fin 104. This position of the valve stem 62 may be referred to as a dispensing configuration. Product and/or propellant may not flow through the orifice positioned between the second fin 104 and the first fin 102. The second fin 104 and the first fin 102 may maintain engagement with the passageway surface 80 and, thus, no product and/or propellant may flow through the orifice positioned between the second fin 104 and the first fin 102.

The valve stem 62 may be positioned in a dispensing configuration upon the actuator being engaged by a user. Thus, the force required to move the valve stem 62 from a sealing configuration to a dispensing configuration is that typically provided by a user. It is to be appreciated that the valve stem 62 may include one or more orifices for dispensing product. However, in some embodiments, additional orifices may be included in the valve stem 62 for filling the container or dispensing product at a different rate. Due to the placement of these additional orifices being closer to the first portion 86 of the valve stem 62 a greater force and/or a greater displacement is required to move the valve stem 62 to a position such that product and/or propellant may flow through these additional orifices.

The valve stem 62 may be moved further in the direction of the interior of the container, such as in the direction indicated by arrow D in FIG. 7. The valve stem 62 may be moved such that both the valve seal 116 and the second fin 104 are no longer sealed with the passageway surface 80. Stated another way, the valve stem 62 may be moved such that the valve seal 116 and the second fin 104 becomes disengaged with the valve body 54 and passageway surface 80, respectively, which breaks the seals. The disengagement may be due to the portion of the valve stem 62, including the valve seal 116 and second fin, extending below the valve body 54. It is to be appreciated that the internal structure of the passageway surface, such as one or more grooves protruding from the passageway surface 80 or a change in diameter of the passageway surface, may be used to interrupt the engagement between the fin and the passageway surface or to break the seal between the valve seal and the valve body. The valve stem 62 may be moved such that the valve seal 116 and the second fin 104 no longer maintain a seal, but the first fin 102 may still maintain engagement with the passageway surface 80 and, thus, maintain a seal.

Disengagement of the second fin 104 and the valve seal 116, allows product and/or propellant to flow into the orifice positioned between both the valve seal 116 and the second fin 104 and the second fin 104 and the first fin 102. This position of the valve stem 62 may be referred to as a filling configuration. The filling configuration may be used, for example, to introduce product and/or propellant into the container during manufacture of the aerosol dispenser. Allowing product and/or propellant to be introduced through multiple orifices may relatively shorten manufacturing times by filling the container more quickly. Also, by having orifices that are positioned between different pairs of fins, the orifices may be different sizes and those sizes may be selected for the particular function of the dispenser. For example, the orifice positioned between the valve seal 116 and the second fin may be sized to allow for product dispensing and the orifice positioned between the second fin and the first fin may be sized to allow for filling of the dispenser. For example, the orifice for product dispensing may be smaller than the orifice for filling the dispenser. It is to be appreciated that the filling configuration may also be used for dispensing. For example, a dispenser may have a first dispensing rate when the stem is positioned in the dispensing configuration and a second dispensing rate, which may be greater than the first dispensing rate, when the stem is positioned in the filling configuration.

The valve assembly may be configured such that to fill the container, product and/or propellant may pass through one or more orifices defined by the valve stem and/or around the outer stem surface 92. Thus, product and/or propellant may flow into the container through the channel 95 and orifices 108 of the valve stem and/or around the outer stem surface 92 of the valve stem. Allowing product and/or propellant to be filled through multiple pathways through the valve assembly and into the container may provide for relatively faster filling of the container. For example, the filling configuration may not require an orifice in the valve stem 62 in fluid communication with the product delivery device 56, but rather may include the condition that the product delivery device 56 be in fluid communication, by way of the passageway 74, with a filling apparatus sealed radially about the passageway.

It is to be appreciated that product and/or propellant may flow through any orifice below which the seal between the valve body and the stem has been broken. It is also to be appreciated that product and/or propellant may pass through the orifices in either direction. Product and/or propellant may flow from the container, through the orifice and into the channel 95 or may flow from the channel 95, through the orifice and into the container. The channel 95 may be in fluid communication with each of the orifices positioned about the valve stem 62. The valve stem 62 may include any number of orifices, fins, and valve seals.

Figure 9B:
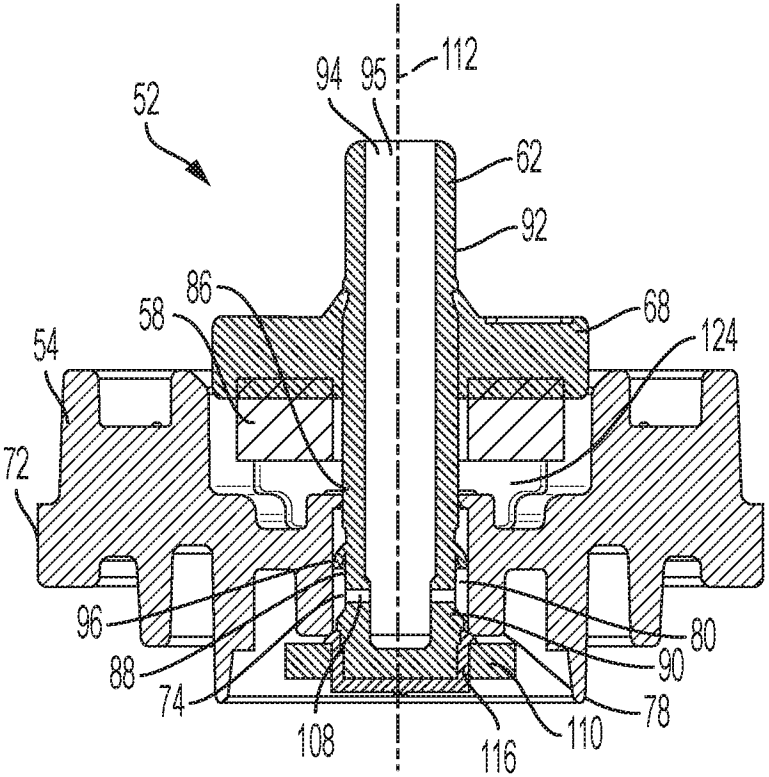
FIG. 9B is a sectional side view of a valve assembly.
Figure 9A:
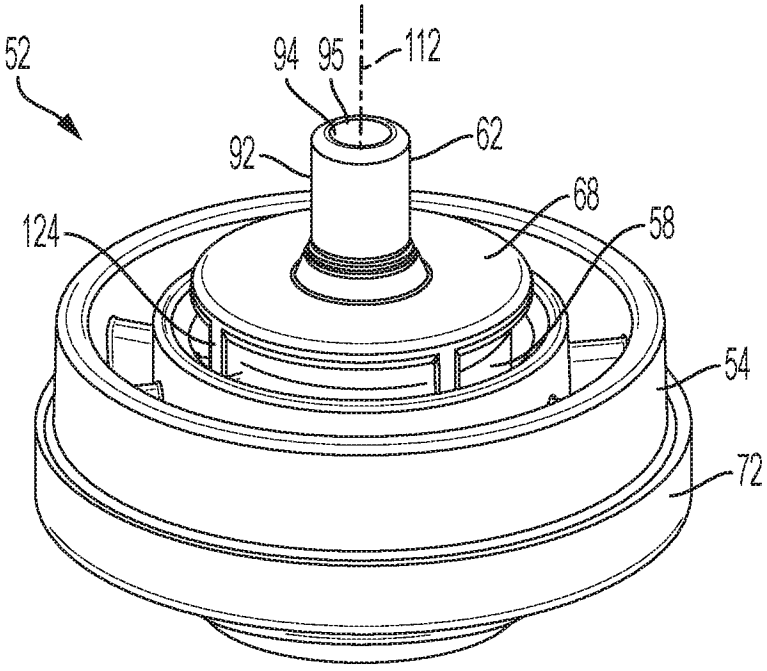
FIG. 9A is a perspective view of a valve assembly.

The valve stem 62 may extend through the inner passageway 74 of the valve body 54, such as illustrated in FIGS. 9A and 9B. The valve stem 62 may extend through the inner passageway 74 such that the first portion 86 of the valve stem 62 is adjacent to the first passageway opening 76, the second portion 88 of the valve stem 62 is substantially surrounded by the passageway surface 80, and the third portion 90 of the valve stem 62 is adjacent to the second passageway opening 78. The first portion 86 of the valve stem 62 may extend beyond the first passageway opening 76 and the third portion 90 of the valve stem 62 may extend beyond on the second passageway opening 78.

Figure 9C:
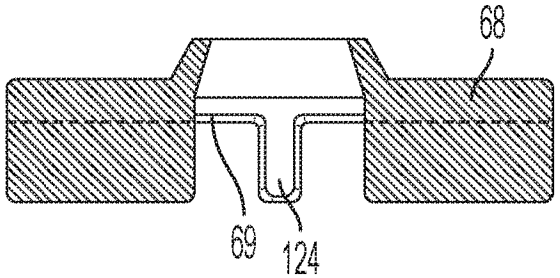
FIG. 9C is a side, sectional view of an engagement member including one or more force concentrators.

The valve assembly 52 may include an engagement member 68. The engagement member 68 may be joined to a portion of the valve stem 62 such that the engagement member 68 moves as the valve stem 62 moves. The engagement member 68 may extend from the outer stem surface 92 towards the outer surface 72 of the valve body 54, such as illustrated in FIGS. 9A and 9B. The engagement member 68 may be axisymmetric or non-axisymmetric. The engagement member 68 includes an engagement surface 69, such as illustrated in FIG. 9C. The engagement surface 69 is configured to operatively engage a portion of the resilient member 58. The resilient member 58 may be positioned between the engagement surface and a portion of the valve body 54. When the valve stem 62 is in a sealing configuration, the engagement surface 69 may operatively engage the resilient member 58 such that the resilient member 58 is placed under a desired amount of compression which biases the valve stem 62 to remain in a position such that a seal is maintained. When the valve stem 62 is in a dispensing configuration, a user or other mechanical device may overcome a force of the resilient member to move the valve stem 62 from the sealing configuration to the dispensing configuration or the filling configuration. As the valve stem 62 moves from the sealing configuration to the dispensing configuration, the engagement member 68 compresses the resilient member 58.

The engagement surface 69 of the engagement member 68 may include one or more force concentrators 124. The one or more force concentrators 124 may be joined to the engagement member 68. The one or more force concentrators 124 may be integrally molded with the engagement member 68 or later added to the engagement member 68. The one or more force concentrators 124 may extend from the engagement surface 69 toward the resilient member 58 and be configured to operatively engage the resilient member 58. The one or more force concentrators 124 concentrate the force applied to the resilient member 58 as the valve stem is moved by a user or other mechanical device. The one or more force concentrators may be used to optimize the force to move the valve stem and the ability of the valve stem to remain in the sealing configuration. The total surface area of the portion of the one or more force concentrators that engages the resilient member 58 is less than the total surface area of the resilient member 58 in facing relationship with the one or more force concentrators. The one or more force concentrators may apply strain to only those portions of the resilient member 58 that are engaged by the one or more force concentrators. The one or more force concentrators 124 may be any shape and size such that a desired force is achieved. For example, the force concentrators may be rectangular, square, conical or tapered, or crescent-shaped. The force concentrators may include a notch or aperture. The one or more force concentrators may extend radially outward from the longitudinal axis or circumferential to the longitudinal axis.

Figure 9D:
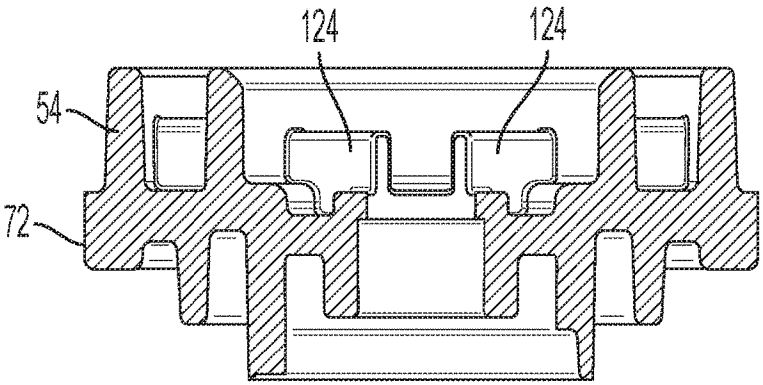
FIG. 9D is a side, sectional view of a valve body including one or more force concentrators.

Referring to FIGS. 9A, 9B, and 9D, the valve body 54 may include one or more force concentrators 124. The one or more force concentrators may be integrally molded with the valve body or later added to the valve body. The one or more force concentrators 124 may extend from the valve body 54 toward the resilient member 68. The resilient member 68 may be disposed on the one or more force concentrators 124 extending from the valve body 54. The one or more force concentrators 124 may be joined to any portion of the valve body 54 such that they operatively engage the resilient member 58. For example, the one or more force concentrators 124 may be joined to the portion of the valve body 54 adjacent to the inner passageway 74. Two or more force concentrators 124 may surround the inner passageway 74 adjacent to the first passageway opening 76. The one or more force concentrators 124 concentrate the force applied to the resilient member 58 as the valve stem is moved by a user or other mechanical device. The one or more force concentrators may be used to optimize the force to move the valve stem and the ability of the valve stem to remain in the sealing configuration. The one or more force concentrators 124 may be any shape and size such that a desired force is achieved, such as previously discussed.

It is to be appreciated that one or more force concentrators 124 may be joined to either the engagement member 68 or the valve body 54. Further, it is to be appreciated that one or more force concentrators 124 may be joined to each of the engagement member 68 and the valve body 54.

For a configuration of the valve assembly where both of the engagement member 68 and the valve body 54 have one or more force concentrators joined thereto, the one or more force concentrators of the valve body 54 may be aligned or offset from the one or more force concentrators of the engagement member 68. For a configuration where the one or more force concentrators of the valve body are offset from the one or more force concentrators of the engagement member, a relatively thinner resilient member may be used because the force concentrators have a greater amount of space in which to travel and act on the resilient member. By contrast, having the one or more force concentrators of the engagement member aligned with the one or more force concentrators of the valve body may require a relatively thicker resilient member to prevent the one or more force concentrators from directly engaging one another and reaching the point that the resilient member is no longer compressible, which may cause the force to move the valve stem to exceed that desired for typical consumer use.

Figure 10:
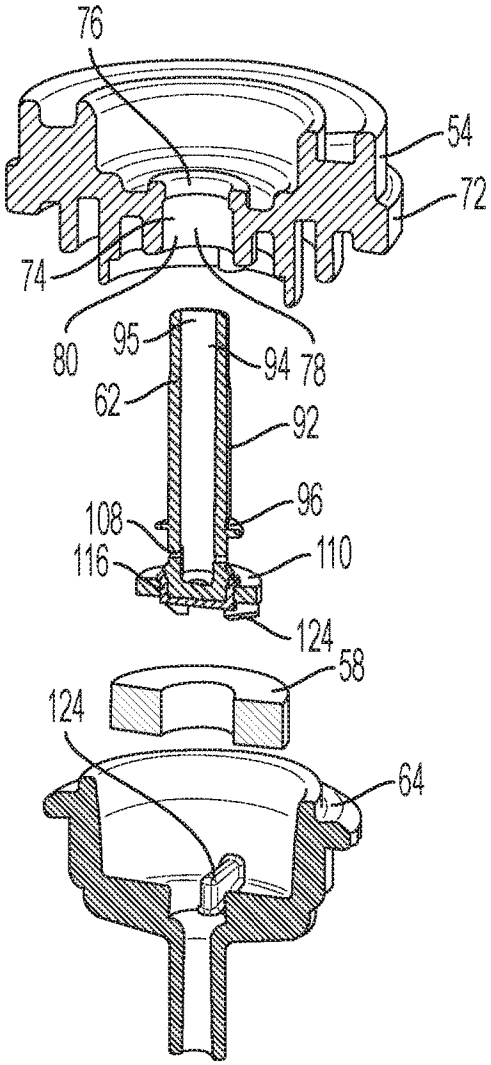
FIG. 10 is an exploded, sectional view of a valve assembly including a valve body, a valve stem, a resilient member, and a dip tub adaptor.

Referring to FIG. 10, the position of the resilient member 58 may be such that the resilient member 58 is between the valve body 54 and the container or a dip tube adaptor 64. Stated another way, the resilient member 58 may be positioned adjacent to the second passageway opening 78 of the inner passageway 74 of the valve body 54. Similar to the above, one or more force concentrators 124 may be joined to the retaining member 110 and/or one or more force concentrators may be joined to the dip tube adaptor 64. The force concentrators are configured to operatively engage the resilient member and create a desired force to move the valve stem.

Figure 11B:
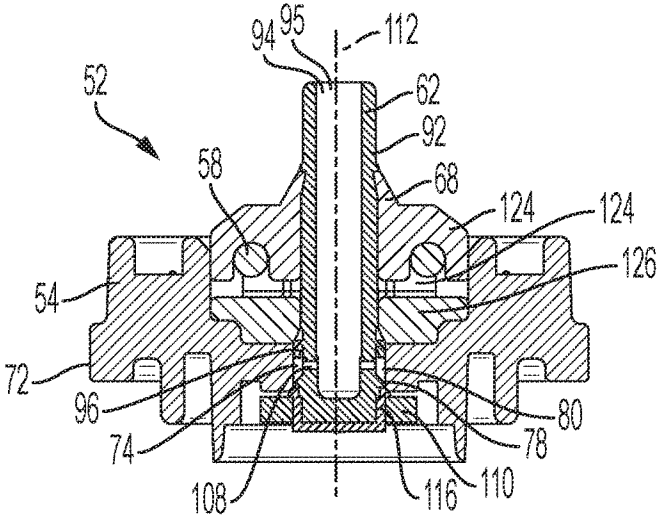
FIG. 11B is a sectional, side view of a valve assembly including a force concentrator member and an engagement member including one or more force concentrators.
Figure 11D:
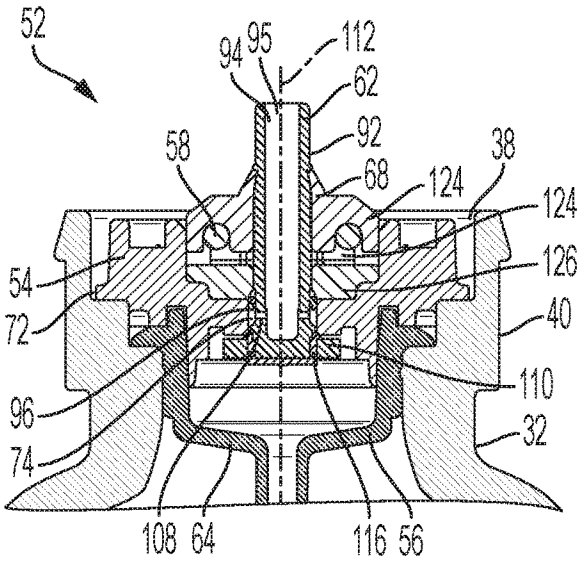
FIG. 11D is a sectional, side view of a valve assembly disposed in the neck of a container.
Figure 11A:
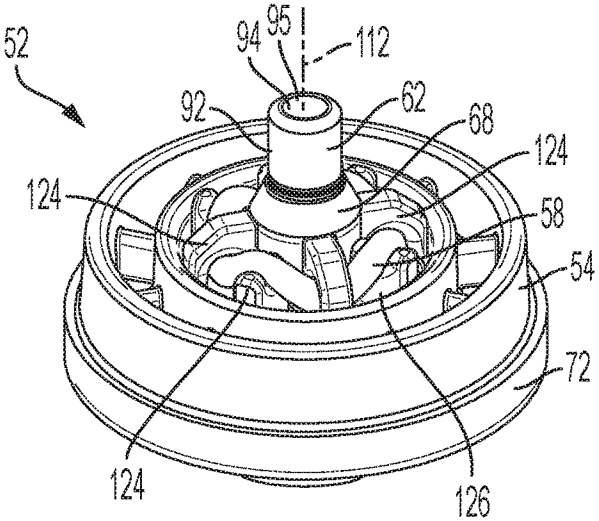
FIG. 11A is a perspective view of a valve assembly including a force concentrator member and an engagement member including one or more force concentrators.
Figure 11C:
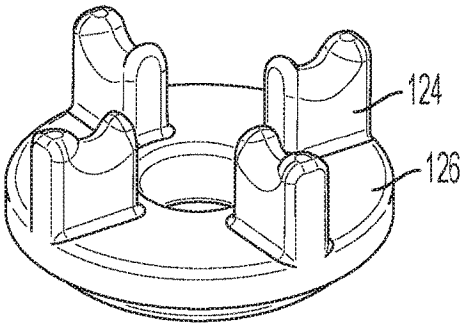
FIG. 11C is a perspective view of a force concentrator member including one or more force concentrators.

The one or more force concentrators may be joined to at least one of the valve body 54, retaining member 110, and the engagement member 68 or the one or more force concentrators may be formed as a separate member and added to the valve assembly, such as illustrated in FIGS. 11A-11D. The engagement member 68 includes one or more force concentrators configured to operatively engage a first portion of the resilient member 58 and a force concentrator member 126 may include one or more force concentrators 124 configured to operatively engage a second portion of the resilient member 58. The one or more force concentrators may be shaped to better position and/or hold the resilient member 58. As illustrated in FIG. 11C, the one or more force concentrators 124 have a substantially concave shape at the portion of the force concentrator that contacts the resilient member 58.

It is to be appreciated that in any of the aforementioned configurations, the one or more force concentrators may be joined to a separate force concentrator member and the member including the one or more force concentrators may be included in the valve assembly to operatively engage the resilient member.

As illustrated in FIG. 11D, the valve assembly 52 may be disposed within at least a portion of the container. The valve assembly 52 may be joined to a portion of the container, such as the neck of the container.

The aforementioned components of the aerosol dispenser 30 may be polymeric. By polymeric it is meant that the component is formed of a material that includes polymers, and/or particularly polyolefins, polyesters or nylons, and more particularly PET. Thus, the entire aerosol dispenser 30 or, specific components thereof, may be free of metal. The container 32, and all other components, may comprise, consist essentially of or consist of PET, PEF (polyethylene furanoate), PEN (polyethylene naphthlate), Nylon, EVOH or combinations thereof. All or substantially all of the components of the aerosol dispenser, excluding the propellant and product, may be configured to be accepted in a single recycling stream. All such materials, or a majority of the components of the aerosol dispenser 30 (excluding the propellant and product) may be comprised of a single class of resin according to ASTM D7611. Particularly, the majority of the aerosol dispenser 30 by weight may be PET. The majority of the valve assembly 52 by weight may be PET.

A permanent or semi-permanent seal may be used to join any or all of the polymeric components of the aerosol dispenser 30. Particularly, if the components have compatible melt indices, such components may be sealed by welding. Suitable welding processes may include sonic, ultrasonic, spin, and laser welding. For example, spin welding provides the benefit that the energy plane is generally confined to a small vertical space, limiting unintended damage of other components not intended to be welded or receive such energy. Welding may be accomplished with a commercially available welder, such as available from Branson Ultrasonics Corp. of Danbury, Conn.

Overpressurization and deformation may occur during heating, either intentionally or inadvertently, of an aerosol dispenser. This overpressurization and deformation may result in rupture of the aerosol dispenser and/or premature loss of propellant and/or product. The valve 52 may be designed such that the deformation is controlled and the release of product and/or propellant is controlled.

The valve stem 62 may be designed, in part, to aid in controlling the overpressurization and deformation of the aerosol dispenser when heated to relatively high temperatures. As previously discussed, the valve stem 62 may include a retaining member 110. The retaining member 110 may be positioned at the third portion 90 of the valve stem 62. The retaining member 110 may be a separate member joined to the valve stem 62 or may be integrally formed, such as by molding, during the manufacture of the valve stem 62. The retaining member 110 may be configured to engage a portion of the valve body 54. For example, the retaining member 110 may be configured to engage the portion of the valve body 54 that is adjacent to the second passageway opening 78. The retaining member 110 may be configured to engage any portion of the valve body 54 and/or the valve seal. The retaining member 110 aids in positioning the valve stem 62 with respect to the inner passageway 74 and aids in preventing the valve stem 62 from being adversely ejected from the valve body 54.

During overpressurization of the dispenser, the retaining member 110 may deform and allow the valve stem 62 to move in a direction away from the valve body and/or valve seal, but not be ejected from the valve body. The retaining member 110 may deform in a manner such that the valve stem 62 moves away from the valve body and/or valve seal to create a flow path which allows product and/or propellant to vent or be released and prevents unsafe ejection of the valve stem from the valve body 54 and/or unsafe discharge of product and/or propellant from the container.

The aerosol dispenser including the aforementioned components may be used to safely vent propellant and/or product when the aerosol dispenser is subject to these relatively high temperatures and/or pressures. The valve assembly is designed to allow for release of the product and/or propellant. When the aerosol dispenser is subject to relatively high temperatures, the valve body may pivot, which allows the valve body to move away from the valve stem. The valve stem may separate from the valve body and break the seals between the valve stem and the valve body so that product and/or propellant may flow from the container, through or around the retaining member, which may include one or more voids, such as apertures, slots, and notches, and be released to the environment. A flow path is created between the valve stem and the valve seal through the movement of the valve body. The movement of the valve body may be away from the container and/or outward toward the neck of the container. An aerosol dispenser including the aforementioned components may safely release product and/or propellant. The valve stem 62 may move to or from any one of a dispensing configuration, a sealing configuration, a filling configuration, and a venting configuration.

As illustrated in FIGS. 12A-14C, the valve assembly 52 may be configured such that the valve stem 62 does not extend above at least one of the upper portion of the neck or the upper portion of the valve body. Thus, at least one of the upper portion of the neck or the upper portion of the valve body protects the valve stem during manufacture and transport of the partially assembled dispenser. More specifically, when the valve stem extends beyond the upper surface of the neck and/or the upper surface of the valve body and prior to an actuator being joined to the valve stem, the valve stem may be inadvertently engaged allowing product and/or propellant to be dispensed or a portion of the valve stem may get damaged. Alternatively, by positioning the valve stem below the upper portion of the neck and/or the upper portion of the valve body, the valve stem may be protected from inadvertent damage or dispensing.

It is also to be appreciated that the resilient member 58 may be positioned in a number of locations with respect to the valve body. These positions are discussed herein in reference to a valve stem that does not extend beyond the upper portion of the valve body. However, it is to be appreciated that these resilient member positions may also be used with a valve stem that extends beyond the valve body.

Figure 12C:
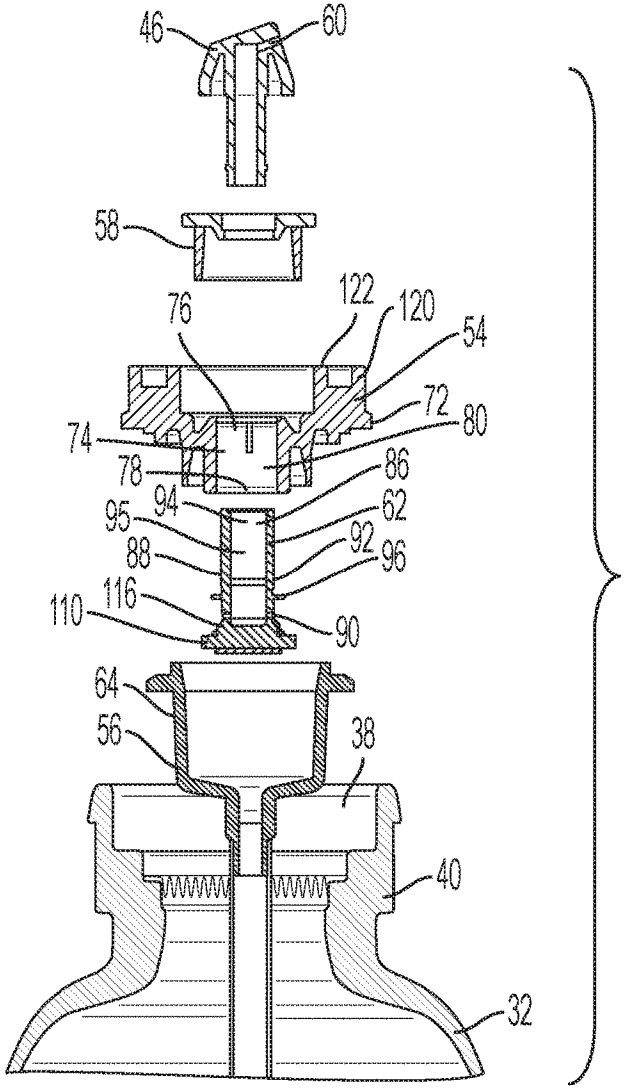
FIG. 12C is a sectional, exploded view of the valve assembly of FIGS. 12A and 12B.
Figure 12A:
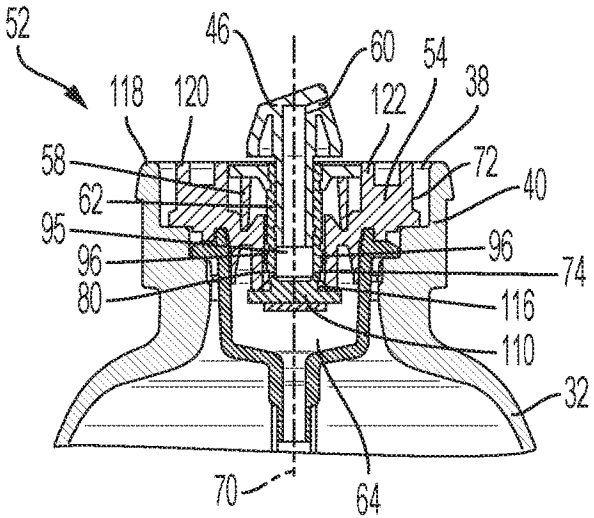
FIG. 12A is a sectional view of a valve assembly in a sealing configuration.
Figure 12B:
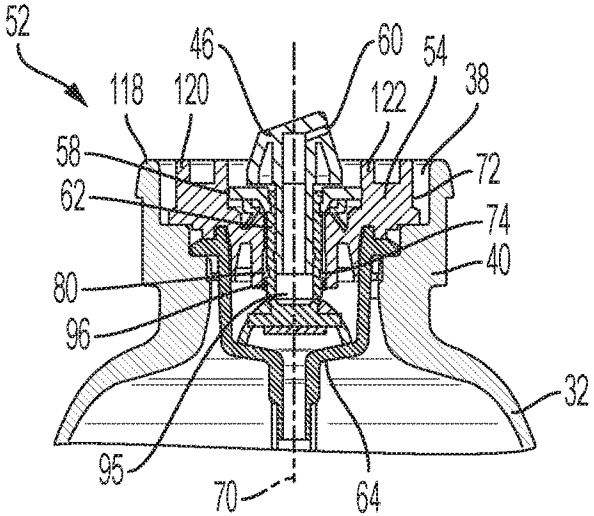
FIG. 12B is a sectional view of a valve assembly in a dispensing configuration.

Referring to FIGS. 12A, 12B, and 12C, as previously described, the container 32 includes a neck 40 and the neck 40 defines an opening 38. The opening 38 is defined, at least in part, by an upper neck portion 118. The upper neck portion 118 may extend about a longitudinal axis 70. The valve body 54 may be inserted into a portion of the neck 40. The valve body 54 may include a first upper valve portion 120 and a second upper valve portion 122, such as illustrated in FIGS. 12A-12C. It is to be appreciated that the valve body 54 may include a single upper valve portion or any number of upper valve portions. The upper valve portion may be the portion of the valve body that is farthest from the bottom of the container. The upper valve portion 120, 122 may extend about at least a portion of the longitudinal axis 70.

The valve stem 62 may be positioned such that a portion of the valve stem 62 extends through the inner passageway 74 of the valve body 54, as previously described. The valve stem 62 includes a first portion 86 which is configured to extend beyond the first passageway opening 76 of the inner passageway 74. However, the first portion 86 does not extend beyond at least one of the upper valve portion 120, 122 and the upper neck portion 118. The upper valve portion 120, 122 and/or the upper neck portion 118 aid in protecting the valve stem 62 prior to, for example, adding an actuator. The valve stem 62 may include an outer stem surface 92 and an inner stem surface 94. A portion of the outer stem surface 92 may be in facing relationship with the passageway surface 80.

The outer stem surface 92 may be joined to a portion of the resilient member 58. The resilient member 58 may be joined to the outer stem surface 92 such that the resilient member 58 moves in response to movement of the valve stem 62. A portion of the resilient member 58 may engage the valve body 54. The valve body 54 is stationary and, thus, the valve body 54 opposes the movement of the resilient member 58. More specifically, a first portion of the resilient member 58 is joined to the outer stem surface 92 and a second portion of the resilient member 58 engages the valve body 54. As the valve stem 62 moves, the resilient member 58 compresses against the stationary valve body 54. FIG. 12A illustrates the resilient member 58 in an uncompressed configuration and FIG. 12B illustrates the resilient member 58 in a compressed configuration. The resilient member 58 is what causes the valve stem 58 to return from a dispensing/filling configuration to a sealing configuration. As the valve stem 62 is moved, the resilient member 58 compresses and biases the valve stem in the opposite direction. When the force causing the valve stem 62 to move is removed, the resilient member 58 causes the valve stem 62 to return to the sealing configuration.

The resilient member may be any compliant member that is configured to be joined to the valve stem and provides for return of the valve stem to the sealing configuration. The resilient member may be any shape such that the resilient member is joined to the valve stem and controls the movement of the valve stem. FIGS. 12A-12C illustrate an annular resilient member, for example. The resilient member may be positioned between the actuator 46 and the valve body 54.

The actuator 46 may be joined to the valve stem 62. The outer surface of the actuator 46 may be joined to the inner stem surface 94 such as illustrated in FIGS. 12A-12C. The actuator 46 may be joined to the valve stem 62 such that when a user engages the actuator 46 the valve stem 62 moves and product and/or propellant flows through the channel 95 of the valve stem 62, through the actuator 46, and out of the nozzle 60. It is to be appreciated that the actuator may be any mechanical device that allows the user to engage it and for product and/or propellant to be released from the container in response to the engagement.

Figure 13C:
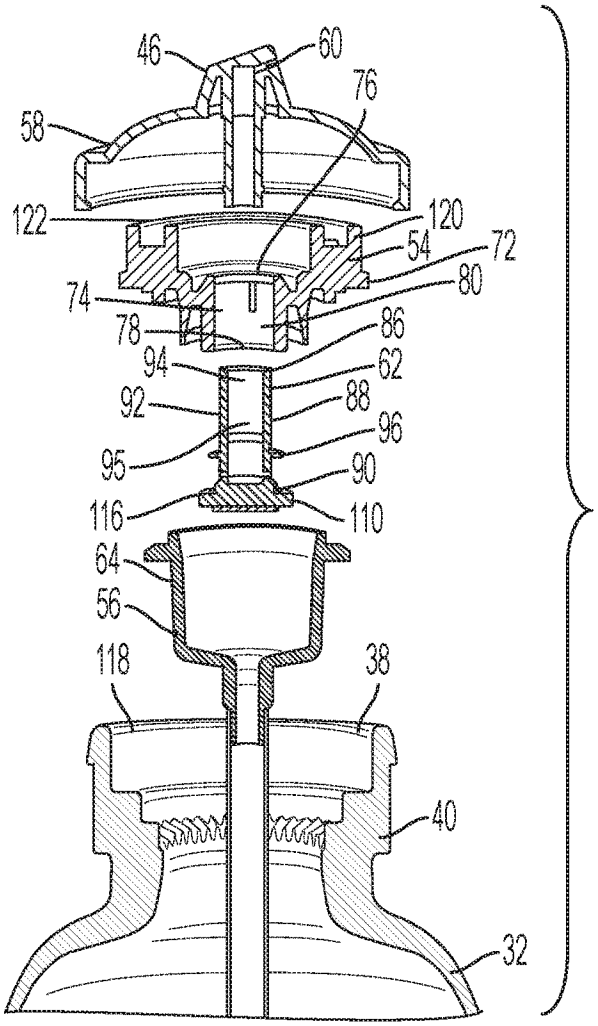
FIG. 13C is a sectional, exploded view of the valve assembly of FIGS. 13A and 13B.
Figure 13A:
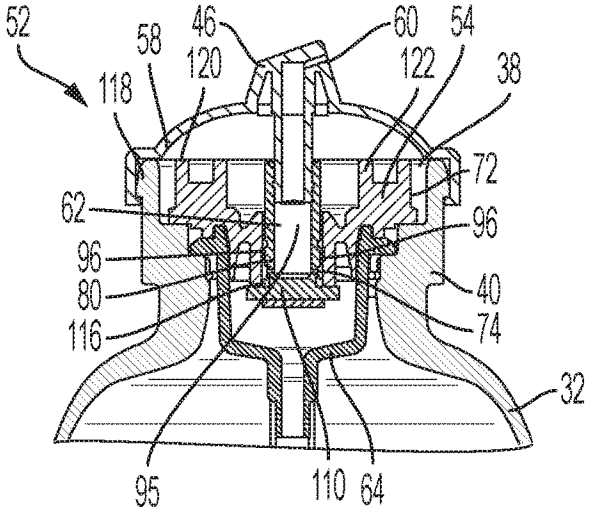
FIG. 13A is a sectional view of a valve assembly in a sealing configuration.
Figure 13B:
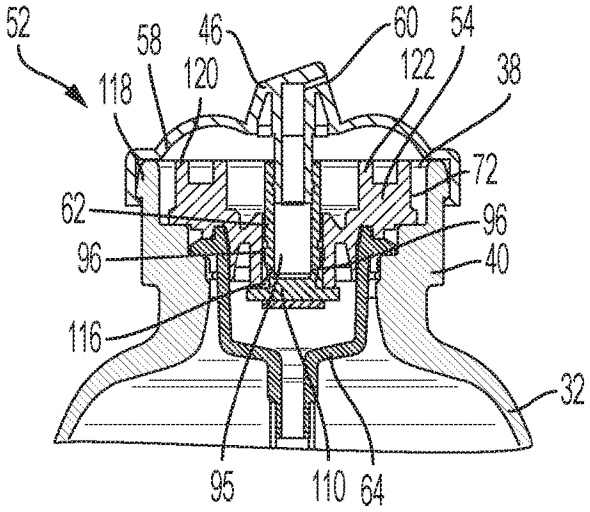
FIG. 13B is a sectional view of a valve assembly in a dispensing configuration.

Referring to FIGS. 13A, 13B, and 13C, as previously described, the container 32 includes a neck 40 and the neck 40 defines an opening 38. The opening 38 is defined at least in part by an upper neck portion 118. The upper neck portion 118 may extend about a longitudinal axis 70. The valve body 54 may be inserted into a portion of the neck 40. The valve body 54 may include a first upper valve portion 120 and a second upper valve portion 122, such as illustrated in FIGS. 13A-13C. It is to be appreciated that the valve body 54 may include a single upper valve portion or any number of upper valve portions. The upper valve portion may be the portion of the valve body that is farthest from the bottom of the container. The upper valve portion 120, 122 may extend about at least a portion of the longitudinal axis 70.

The valve stem 62 may be positioned such that a portion of the valve stem 62 extends through the inner passageway 74 of the valve body 54, as previously described. The valve stem 62 includes a first portion 86 which does not extend beyond the first passageway opening 76 of the inner passageway 74. The first portion 86 of the valve stem 62 may be disposed within the inner passageway 74 of the valve body 54. The first portion 86 does not extend beyond at least one of the upper valve portion 120, 122 and the upper neck portion 118. The upper valve portion 120, 122, the upper neck portion 118, and/or the inner passageway 74 aid in protecting the valve stem 62 prior to, for example, adding an actuator. The valve stem 62 may include an outer stem surface 92 and an inner stem surface 94. At least a portion of the outer stem surface 92 may be in facing relationship with the passageway surface 80.

The actuator 46 may be joined to the valve stem 62. The outer surface of the actuator 46 may be joined to the inner stem surface 94 such as illustrated in FIGS. 13A-13C. The actuator 46 may be joined to the valve stem 62 such that when a user engages the actuator 46 the valve stem 62 moves to a dispensing configuration and product and/or propellant flows through the channel 95 of the valve stem 62, through the actuator 46, and out of the nozzle 60.

The actuator 46 may be joined to a portion of the resilient member 58. The resilient member 58 may be joined to the actuator 46 such that the resilient member 58 moves in response to movement of the actuator 46. A portion of the resilient member 58 may engage the neck 40 of the outer container. The neck 40 is stationary and, thus, the neck 40 opposes the movement of the resilient member 58. More specifically, a first portion of the resilient member 58 is joined to the actuator 46 and a second portion of the resilient member 58 engages the neck 40. As the actuator 46 moves, the resilient member 58 compresses against the stationary neck 40. FIG. 13A illustrates the resilient member 58 in an uncompressed configuration and FIG. 13B illustrates the resilient member 58 in a compressed configuration. The resilient member 58 is what causes the valve stem 58 to return from a dispensing configuration to a sealing configuration. As the valve stem 62 is moved by engagement of the actuator 46, the resilient member 58 compresses and biases the valve stem in the opposite direction, which may include away from the bottom of the container. When the force causing the valve stem 62 to move is removed, the resilient member 58 causes the valve stem 62 to return to the sealing configuration. As illustrated in FIGS. 13A-13C, the resilient member 58 may be positioned above the valve stem 62 or, stated another way, the valve stem 62 and the valve body 54 may be positioned between the resilient member 58 and the bottom of the container.

Figure 14C:
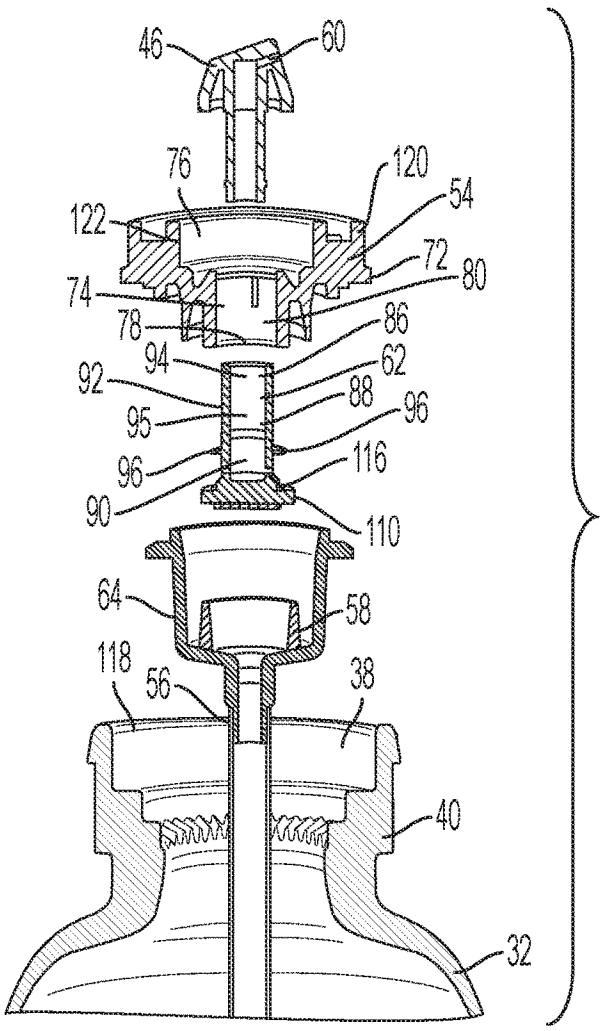
FIG. 14C is a sectional, exploded view of the valve assembly of FIGS. 14A and 14B.
Figure 14A:
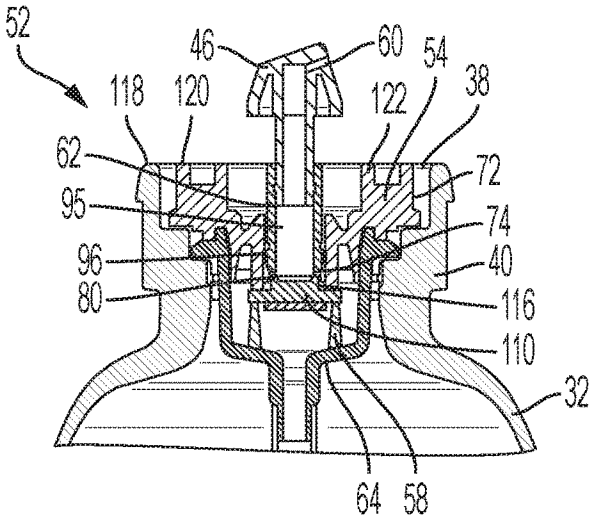
FIG. 14A is a sectional view of a valve assembly in a sealing configuration.
Figure 14B:
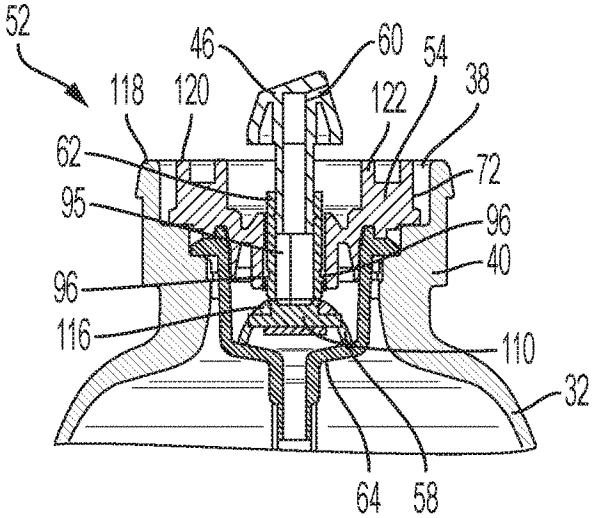
FIG. 14B is a sectional view of a valve assembly in a dispensing configuration.

Referring to FIGS. 14A, 14B, and 14C, as previously described, the container 32 includes a neck 40 and the neck 40 defines an opening 38. The opening 38 is defined at least in part by an upper neck portion 118. The upper neck portion 118 may extend about a longitudinal axis 70. The valve body 54 may be inserted into a portion of the neck 40. The valve body 54 may include a first upper valve portion 120 and a second upper valve portion 122, such as illustrated in FIGS. 14A-14C. It is to be appreciated that the valve body 54 may include a single upper valve portion or any number of upper valve portions. The upper valve portion may be the portion of the valve body that is farthest from the bottom of the container. The upper valve portion 120, 122 may extend about at least a portion of the longitudinal axis 70.

The valve stem 62 may be positioned such that a portion of the valve stem 62 extends through the inner passageway 74 of the valve body 54, as previously described. The valve stem 62 includes a first portion 86 which does not extend beyond the first passageway opening 76 of the inner passageway 74. The first portion 86 of the valve stem 62 may be disposed within the inner passageway 74 of the valve body 54. The first portion 86 does not extend beyond at least one of the upper valve portion 120, 122 and the upper neck portion 118. The upper valve portion 120, 122, the upper neck portion 118, and/or the inner passageway 74 aid in protecting the valve stem 62 prior to, for example, adding an actuator. The valve stem 62 may include an outer stem surface 92 and an inner stem surface 94. At least a portion of the outer stem surface 92 may be in facing relationship with the passageway surface 80.

The actuator 46 may be joined to the valve stem 62. The outer surface of the actuator 46 may be joined to the inner stem surface 94 such as illustrated in FIGS. 13A-13C. The actuator 46 may be joined to the valve stem 62 such that when a user engages the actuator 46 the valve stem 62 moves and product and/or propellant flows through the channel 95 of the valve stem 62 and through the actuator 46 and out of the nozzle 60.

A resilient member 58 may be positioned opposite the actuator 46. The resilient member 58 may be positioned such that the valve stem 62 is positioned between the actuator 46 and the resilient member 58. The resilient member 58 may be joined to the dip tube adaptor 64. The resilient member 58 may extend from the dip tube adaptor 64 toward the valve stem 62 such that the valve stem 62 engages a portion of the resilient member 58. The resilient member 58 moves in response to movement of the valve stem 62. The dip tube adaptor 64 is stationary and, thus, the dip tube adaptor 64 opposes the movement of the resilient member 58. More specifically, a first portion of the resilient member 58 is joined to dip tube adaptor 64 and a second portion of the resilient member 58 engages the valve stem 64. As the actuator 46 moves, the valve stem 62 moves and engages the resilient member 58 which compresses against the dip tube adaptor 64. FIG. 14A illustrates the resilient member 58 in an uncompressed configuration and FIG. 14B illustrates the resilient member 58 in a compressed configuration. The resilient member 58 is what causes the valve stem 58 to return from a dispensing configuration to a sealing configuration. As the valve stem 62 is moved by engagement of the actuator 46, the resilient member 58 compresses and biases the valve stem in the opposite direction. When the force causing the valve stem 62 to move is removed, the resilient member 58 causes the valve stem 62 to return to the sealing configuration. As illustrated in FIGS. 14A-14C, the resilient member 58 may be positioned below the valve stem 62 or, stated another way, the valve stem 62 and the resilient member 58 may be positioned between the valve body 54 and the bottom of the container.

Figure 15B:
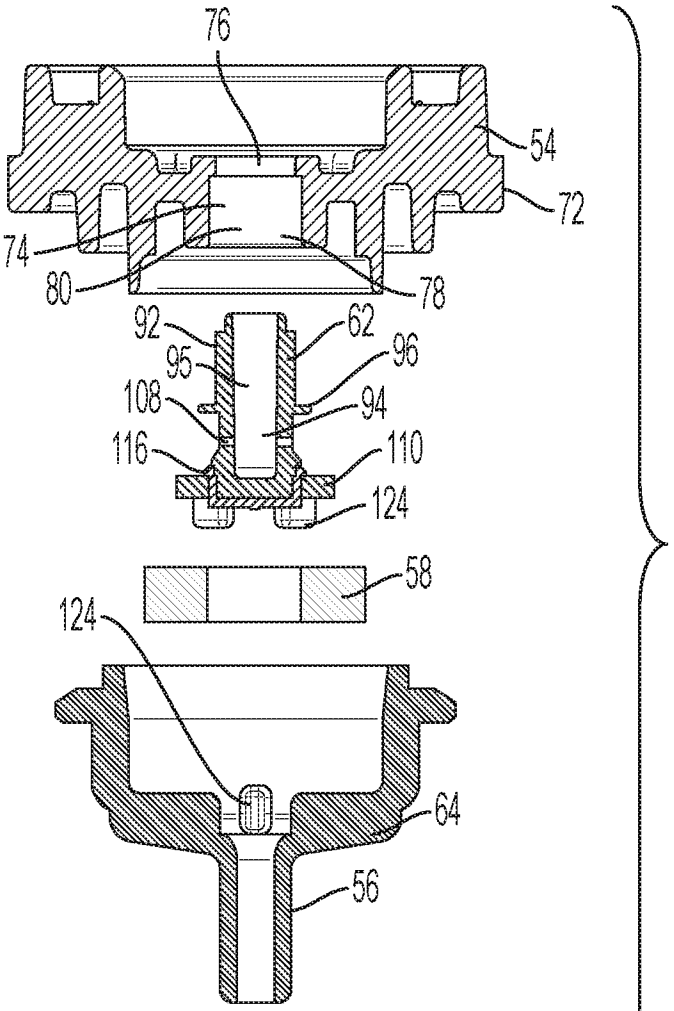
FIG. 15B is a sectional, exploded view of the valve assembly of FIG. 15A.
Figure 15A:
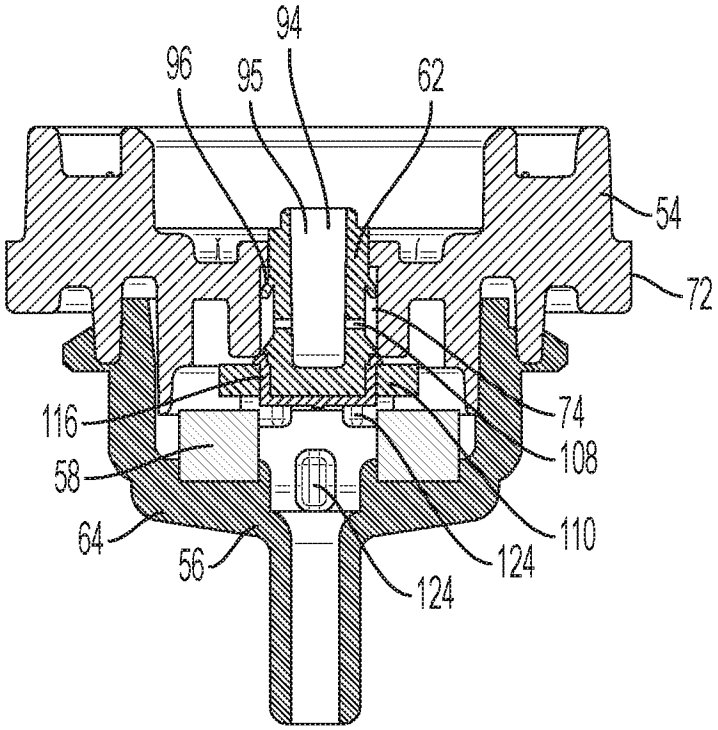
FIG. 15A is a sectional view of a valve assembly including a dip tub adaptor and retaining member that each include one or more force concentrators.

As illustrated in FIGS. 15A and 15B, the valve stem 62 may be configured such that the valve stem 62 does not extend beyond the upper portion of the valve body 54. This configuration may protect the valve stem during manufacturing processes and/or shipping. Similar to the above, an actuator may be joined to the valve stem 62 to control the movement of the valve stem.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

It should be understood that every maximum numerical limitation given throughout this specification will include every lower numerical limitation, as if such lower numerical limitations were expressly written herein. Every minimum numerical limitation given throughout this specification will include every higher numerical limitation, as if such higher numerical limitations were expressly written herein. Every numerical range given throughout this specification will include every narrower numerical range that falls within such broader numerical range, as if such narrower numerical ranges were all expressly written herein.

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A valve for a dispenser, the valve comprising:

a valve body extending about a longitudinal axis, the valve body defining an outer surface and an inner passageway, wherein the inner passageway comprises a first passageway opening and a second passageway opening and a passageway surface extending from the first passageway opening to the second passageway opening; and a valve stem extending through the inner passageway, wherein the valve stem comprises an outer stem surface and an inner stem surface opposite the outer stem surface, and wherein the valve stem comprises a first portion adjacent to the first passageway opening, a second portion substantially surrounded by the passageway surface, and a third portion adjacent to the second passageway opening;

a valve seal joined to the third portion of the valve stem;

a fin extending radially outward from the outer stem surface; and a first orifice extending from the outer stem surface to the inner stem surface, wherein the inner stem surface defines a channel in fluid communication with the first orifice, wherein the fin comprises a root portion joined to the outer stem surface and a tip portion opposite the root portion, wherein the tip portion of the fin operatively engages the passageway surface to form a seal, and wherein one or more force concentrators joined to the retaining member and a resilient member disposed adjacent to the retaining member, wherein the one or more force concentrators are configured to engage the resilient member.

2. The valve of claim 1, wherein the first portion of the valve stem extends through the first passageway opening and the third portion of the valve stem extends through the second passageway opening.

3. The valve of claim 1, comprising an engagement member joined to a portion of the valve stem and a resilient member disposed between the engagement member and a portion of the valve body.

4. The valve of claim 3, wherein the resilient member is made from a thermoplastic elastomer.

5. The valve of claim 3, wherein the engagement member comprises one or more force concentrators configured to operatively engage a portion of the resilient member.

6. The valve of claim 3, wherein the valve body comprises one or more force concentrators configured to operatively engage a portion of the resilient member.

7. The valve of claim 1, comprising a retaining member joined to the third portion of the valve stem, wherein the retaining member is positioned adjacent to the second passageway opening.

8. The valve of claim 1, wherein the first orifice is positioned between the fin and the valve seal.

9. The valve of claim 1, comprising a second fin extending radially outward from the outer stem surface, wherein the second fin comprises a second root portion joined to the outer stem surface and a second tip portion opposite the second root portion, wherein the second tip portion is configured to operatively engage the passageway surface.

10. The valve of claim 9, comprising a second orifice extending from the outer stem surface to the inner stem surface and in fluid communication with the channel, wherein the second orifice is positioned between the first fin and the second fin.

11. The valve of claim 1, wherein the channel extends from the first orifice to a dispensing opening.

12. The valve of claim 1, wherein the valve body, the valve stem, and the valve seal are made from one or more polymeric materials.

13. A pressurizable container for dispensing a product, the pressurizable container comprising:

a container;

a valve body joined to the container, the valve body defining an outer surface and an inner passageway, wherein the inner passageway comprises a first passageway opening and a second passageway opening and a passageway surface extending from the first passageway opening to the second passageway opening; and a valve stem extending through the passageway, wherein the valve stem comprises an outer stem surface and an inner stem surface opposite the outer stem surface;

a fin extending radially outward from the outer stem surface, wherein the fin comprises a root portion joined to the outer stem surface and a tip portion opposite the root portion, and wherein the tip portion of the fin operatively engages the passageway surface to form a first seal;

a valve seal joined to the valve stem, wherein the valve seal is configured to operatively engage a portion of the valve body to form a second seal;

a product delivery device in fluid communication with the valve body;

a retaining member joined to the valve stem; and one or more force concentrators joined to the retaining member; and a resilient member disposed adjacent to the retaining member, wherein the one or more force concentrators are configured to operatively engage the resilient member.

14. The pressurizable container of claim 13, comprising a propellant disposed in the container.

15. The pressurizable container of claim 13, comprising an engagement member joined to the valve stem and a resilient member disposed between the engagement member and the valve body.

16. The pressurizable container of claim 15, comprising one or more force concentrators joined to the engagement member and configured to operatively engage the resilient member.

17. The pressurizable container of claim 15, comprising one or more force concentrators joined to the valve body, wherein the one or more force concentrators of the valve body are configured to operatively engage the resilient member.

18. The pressurizable container of claim 13, wherein the product delivery device comprises a dip tube adaptor.

19. The pressurizable container of claim 18, comprising one or more force concentrators joined to the dip tub adaptor and a resilient member disposed on the dip tube adaptor, wherein the one or more force concentrators are configured to operatively engage the resilient member.

* * * * *